US011112199B2

(12) United States Patent
Pizano

(10) Patent No.: US 11,112,199 B2
(45) Date of Patent: Sep. 7, 2021

(54) SLIDE ACTION RIFLE WITH A BOLT CARRIER LOCKING MECHANISM EXTERNAL TO THE RECEIVER

(71) Applicant: Jorge Pizano, Cordova, TN (US)

(72) Inventor: Jorge Pizano, Cordova, TN (US)

( * ) Notice: Subject to any disclaimer, the term of this patent is extended or adjusted under 35 U.S.C. 154(b) by 0 days.

(21) Appl. No.: 15/817,138

(22) Filed: Nov. 17, 2017

(65) Prior Publication Data

US 2019/0154382 A1 May 23, 2019

(51) Int. Cl.

| | |
|---|---|
| ***F41A 19/47*** | (2006.01) |
| ***F41C 7/02*** | (2006.01) |
| ***F41A 3/72*** | (2006.01) |
| ***F41A 3/26*** | (2006.01) |
| ***F41A 3/38*** | (2006.01) |
| ***F41A 5/18*** | (2006.01) |
| ***F41A 5/30*** | (2006.01) |

(52) U.S. Cl.

CPC ..... *F41A 19/47* (2013.01); *F41A 3/26* (2013.01); *F41A 3/38* (2013.01); *F41A 3/72* (2013.01); *F41A 5/18* (2013.01); *F41A 5/30* (2013.01); *F41C 7/02* (2013.01)

(58) Field of Classification Search

CPC .... F41A 3/72; F41A 5/18; F41A 19/47; F41C 7/02

See application file for complete search history.

(56) References Cited

U.S. PATENT DOCUMENTS

| | | | | |
|---|---|---|---|---|
| 913,047 | A * | 2/1909 | Peltier | F41A 21/482 42/6 |
| 4,930,399 | A * | 6/1990 | Trevor, Jr. | F41A 3/46 89/185 |
| 6,019,024 | A * | 2/2000 | Robinson | F41A 3/72 89/1.42 |
| 7,971,379 | B2 * | 7/2011 | Robinson | F41A 3/26 42/7 |
| 8,141,285 | B2 * | 3/2012 | Brown | F41A 3/66 42/71.01 |
| 8,468,929 | B2 * | 6/2013 | Larson | F41A 5/28 89/191.01 |
| 8,667,882 | B1 * | 3/2014 | Larson | F41A 3/66 89/140 |
| 9,032,860 | B2 * | 5/2015 | Faxon | F41A 15/14 89/193 |
| 9,109,848 | B2 * | 8/2015 | Brown | F41A 3/72 |
| 9,188,401 | B2 * | 11/2015 | Pizano | F41A 7/02 |
| 9,341,420 | B2 * | 5/2016 | Foster | F41A 3/72 |

(Continued)

OTHER PUBLICATIONS

Iraqveteran8888, "Troy Pump Action AR-15", https://www.youtube.com/watch?v=OYRRzus9wto, (Year: 2014).*

*Primary Examiner* — Joshua T Semick

(57) ABSTRACT

A slide action conversion assembly for converting a gas operated rifle into a manually operated slide action rifle. The conversion assembly replaces the gas operating system of the rifle with a linkage assembly attached to the original bolt carrier at a rearward end and to a sliding handguard grounded to a replacement stationary handguard at forward end. The linkage reciprocates within one degree of freedom along a path parallel to the barrel in order to manually cycle the converted firearm. The conversion assembly further incorporates a sliding handguard locking mechanism to prevent manual cycling when the firearm is in battery.

1 Claim, 27 Drawing Sheets

Figure 1:
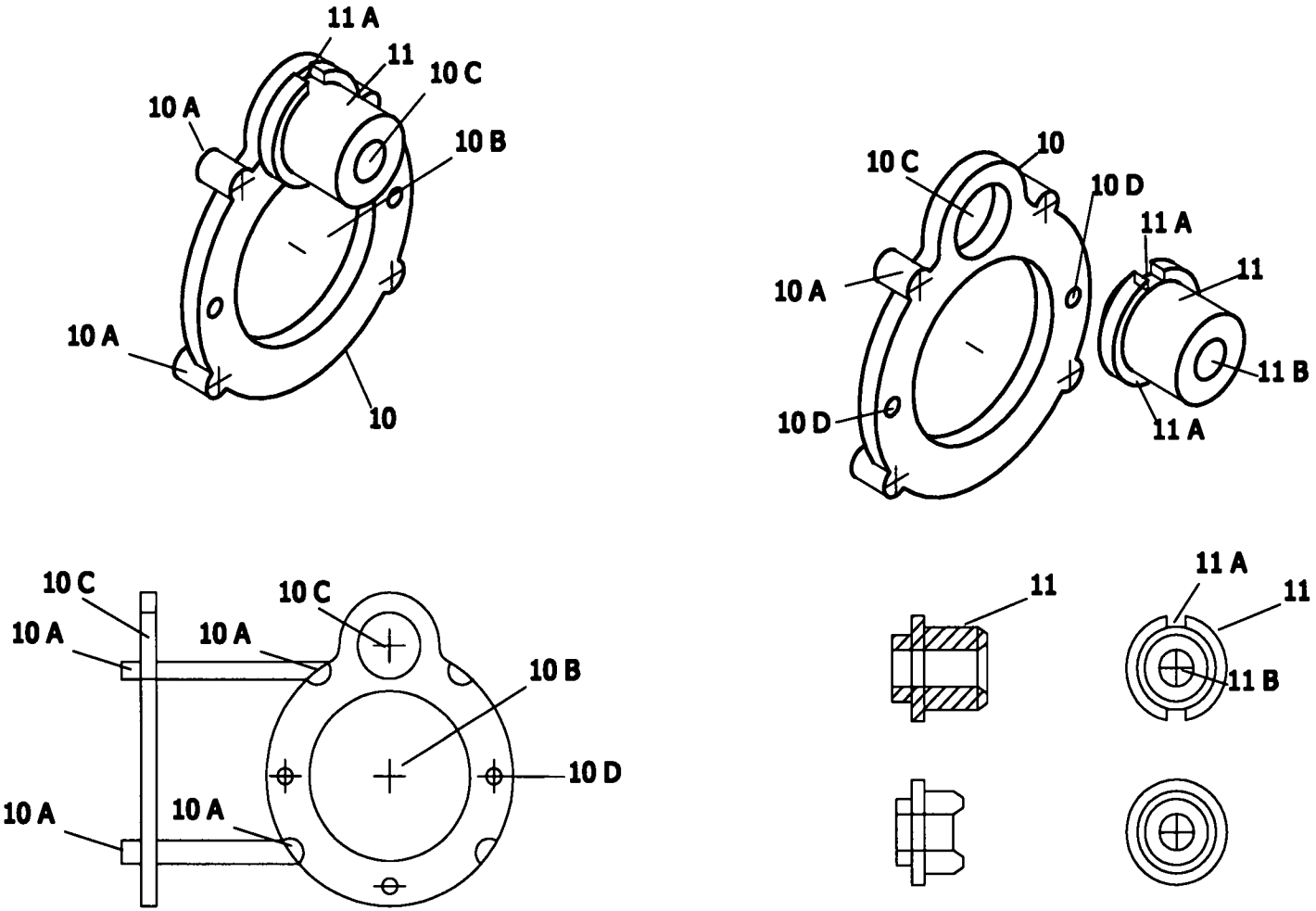

SCHEMATIC ISOMETRIC VIEW OF THE LINEARLY SLIDING PUSH PULL BAR AND PARTS ATTACHED, AND EXTERIORLY CONNECTED AND LOCKED TO THE LINEARLY SLIDING HAND GUARD TO PERFORM THE PUMP ACTION CHARGING ACTION. THIS SCHEMATIC CONSTITUTES THE COMPLETE SLIDING ACTION TRAIN.

(56) References Cited

U.S. PATENT DOCUMENTS

| | | | | |
|---|---|---|---|---|
| 9,347,737 | B2 * | 5/2016 | Troy | F41A 35/06 |
| 9,513,074 | B1 * | 12/2016 | Steil | F41A 5/18 |
| 9,638,481 | B1 * | 5/2017 | Marano | F41A 3/72 |
| 10,254,060 | B2 * | 4/2019 | Hoon | F41A 5/28 |

* cited by examiner

TUBE SUPPORT ADDAPTER PLATE

BOLT CARRIER GAS KEY REPLACEMENT

FIG. 3 BOLT CARRIER WITH GAS KEY REPLACEMENT ATTACHED

SECTIONAL CUT D-D SCALED UP SHOWS THROUGH CUT HOLE 80D ON PUSH PULL ROD.

GUIDE SUPPORT TUBE

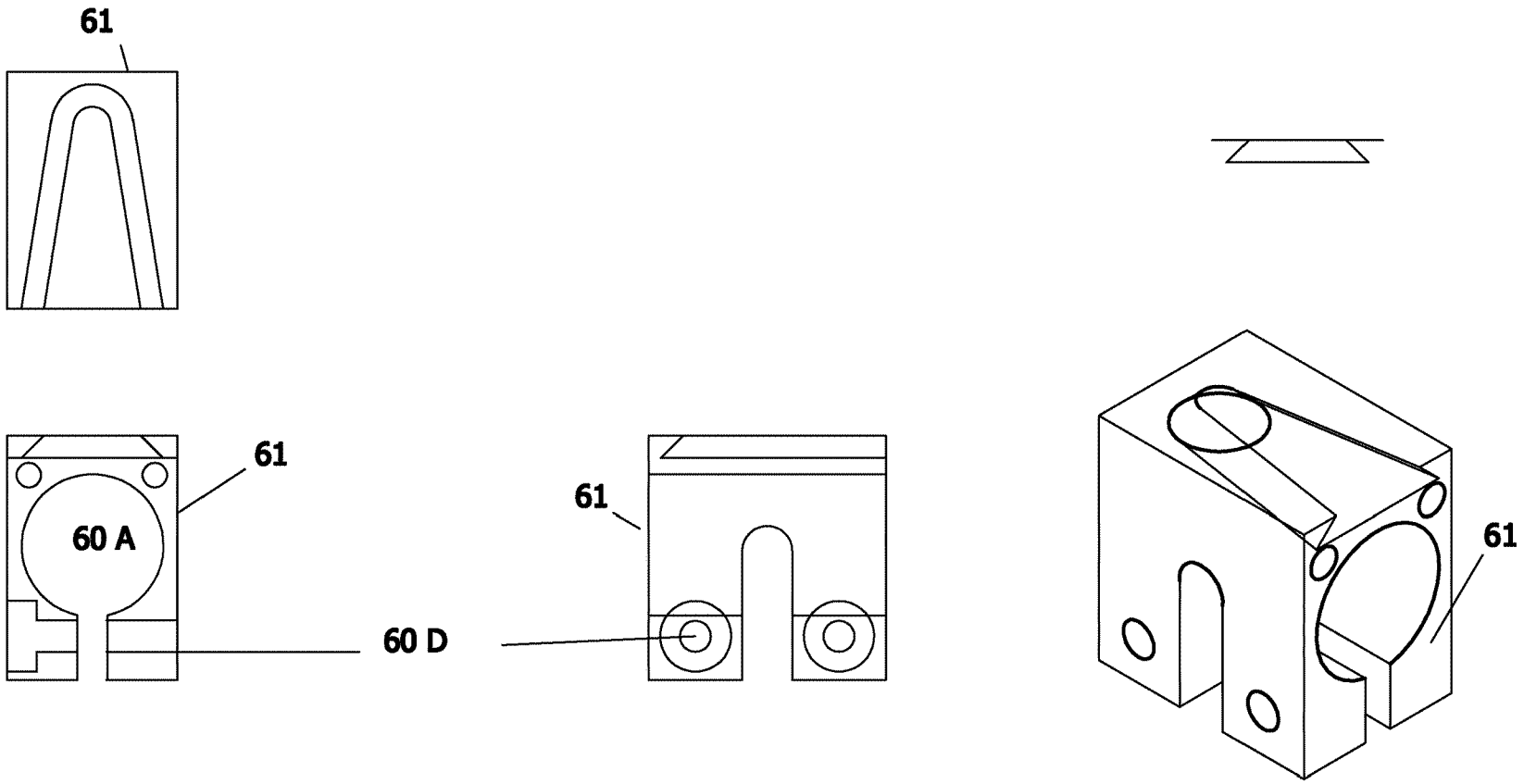
FIG. 5 LOWER SUPPORT BLOCK BLOCK

UPPER TUBE AND LINKAGE SUPPORT BLOCK

SCHEMATIC ORTHOGRAPHIC VIEW OF THE LINEARLY SLIDING PUSH PULL BAR AND PARTS ATTACHED

SCHEMATIC ISOMETRIC VIEW OF THE LINEARLY SLIDING PUSH PULL BAR (80) AND PARTS ATTACHED
ALL PARTS BECOME A "SOLID" WITH ZERO DEGREES OF FREEDOM RELATIVE TO EACH OTHER

SCHEMATIC ORTHOGRAPHIC VIEW OF THE LINEARLY SLIDING HANDGUARD (95) ALONG THE GROUNDED STATIONARY HANDGUARD (94).

SCHEMATIC ORTHOGRAPHIC VIEW OF THE PLACEMENT OF LOCKING LEVER ARM MECHANISM (96) ON THE THE LINEARLY SLIDING HANDGUARD (95), AND CONNECTING WITH THE ROD DRIVER (31)

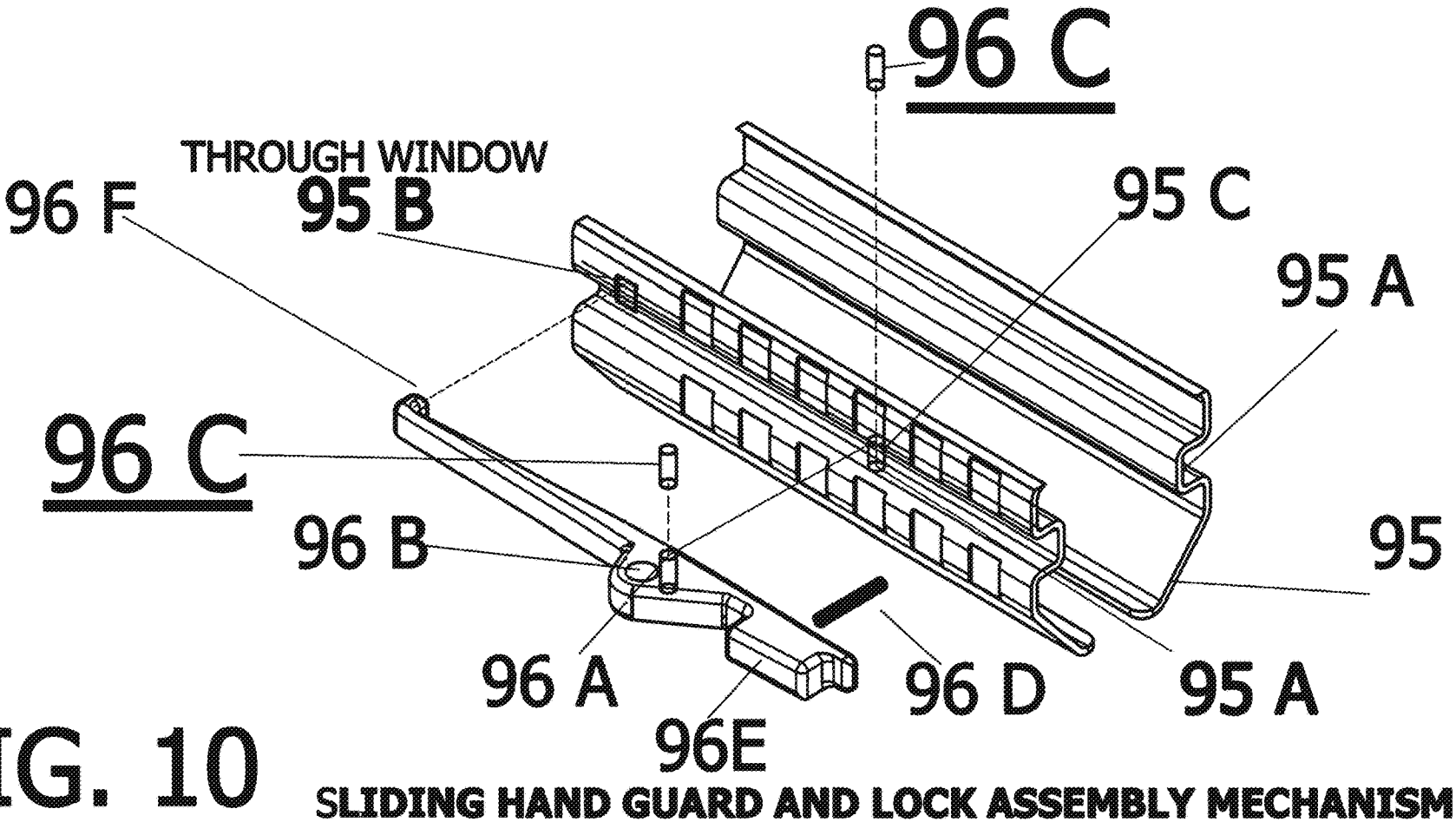
FIG. 10 SLIDING HAND GUARD AND LOCK ASSEMBLY MECHANISM

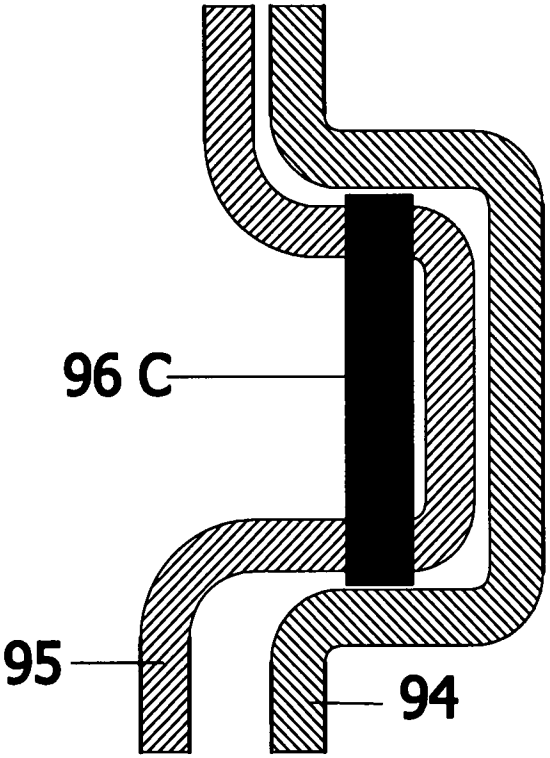
NOTICE THAT THE BARREL (14) REMAINS FLOATING, UNTOUCHED BY THE STRUCTURAL HANDGUARD (94).
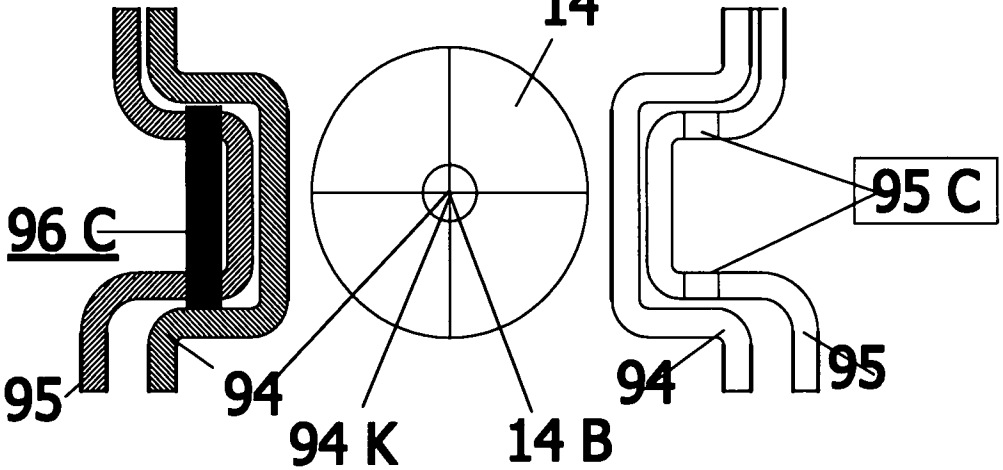
SECTION VIEW SHOWING HOW THE PIN 96 IS IMPRISSONED BETWEEN THE HAND GUARD 94 AND THE SLIDER 95. THE PIN MOVES ALLTOGETHER CONNECTING 95 AND LEVER 96. ALL MOVE .
FIG. 10 A SCHEMATIC ISOMETRIC VIEW OF THE LINEARLY SLIDING PUSH PULL BAR AND PARTS ATTACHED, AND EXTERIORLY CONNECTED AND LOCKED TO THE LINEARLY SLIDING HAND GUARD TO PERFORM THE PUMP ACTION CHARGING ACTION. THIS SCHEMATIC CONSTITUTES THE COMPLETE SLIDING ACTION TRAIN.

SCHEMATIC VIEW OF THE LINEARLY SLIDING PUSH PULL BAR AND PARTS ATTACHED

SCHEMATIC VIEW OF THE LINEARLY SLIDING PUSH PULL BAR AND PARTS ATTACHED AND EXTERIORLY CONNECTED AND LOCKED TO THE LINEARLY SLIDING HAND GUARD TO PERFORM THE PUMP ACTION CHARGING ACTION

EXTERNAL SLIDING HANDGUARD IN FORWARD POSITION.
BOLT IN BATTERY.
EXTERNAL SLIDING HANDGUARD IN REARWARD POSITION.
BOLT IN OPEN POSITION .
14
51
97
95
96
31 A
70
10
80
16A
16
94
12

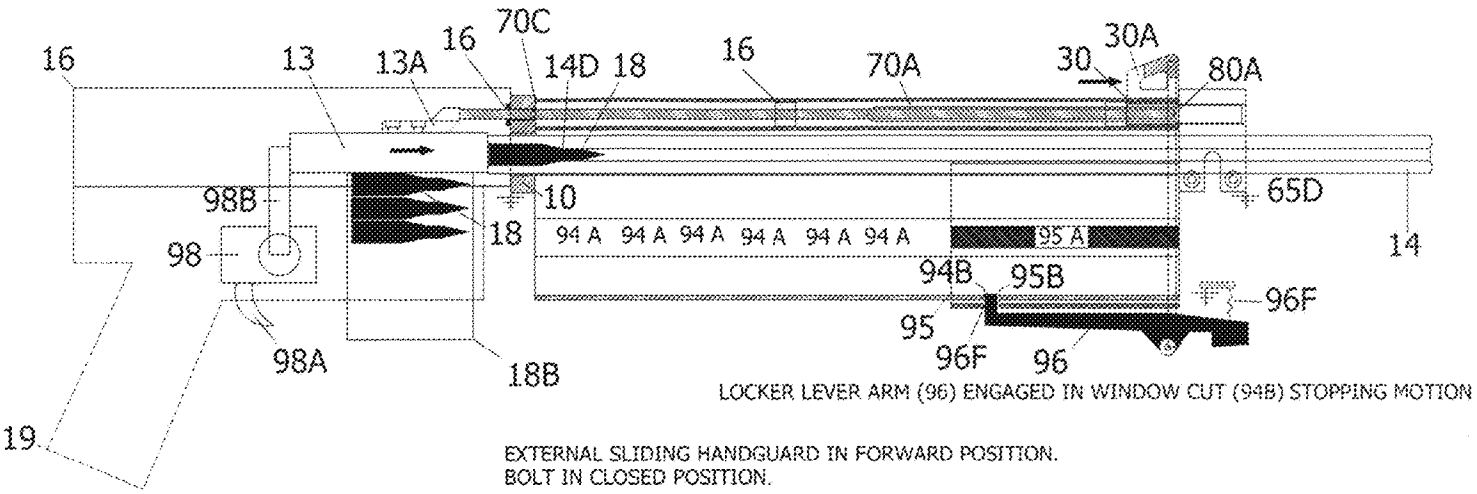
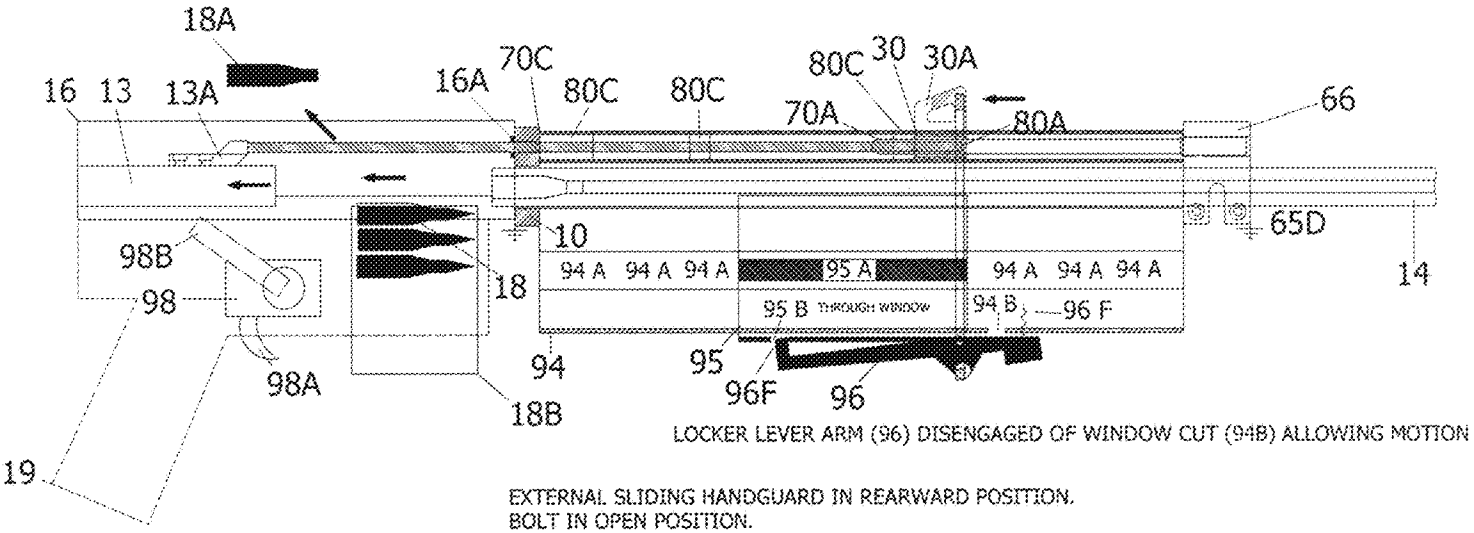
FIG. 17

ONE PIECE GAS BLOCK

SLIDE ACTION RIFLE WITH A BOLT CARRIER LOCKING MECHANISM EXTERNAL TO THE RECEIVER

CROSS REFERENCE TO RELATED APPLICATIONS

This Application claims the benefit of Provisional Patent Application Ser. No. 62/497,414 filed on Nov. 17, 2016 by the present inventor; and of Provisional Patent Application Ser. No. 61/686,226 filed on Apr. 2, 2012 by the present Applicant. Then Non Provisional application Ser. No. 13/855,038 filed on Apr. 2, 2013, Now U.S. Pat. No. 9,188,401 of Nov. 17, 2015, Named "Combined direct drive gas piston system, and frontal, ambidextrous, non-reciprocating, charging system for auto loading rifle" by the present Applicant.

TERMS DEFINITION

The term "Action", in firearms terminology, is the mechanism that handles the ammunition (loads, locks, fires, and extracts the cartridges) or the method by which that reloading mechanism works.

The term Slide Action refers to reloading and extracting a spent case from a repeating firearm in which a new round is brought from the magazine into the breech by a linear, parallel to the barrel, motion of an exterior to the barrel hand guard.

A Forend or Forend Grip, in firearms terminology, is a frontal handguard, static or mobile, to place the Supporting hand of the shooter.

A self-disconnection mechanism, or trigger disconnector. In firearms terminology the disconnect member links the trigger and the hammer in the cocked position, but is disconnected from the trigger when the hammer is released. The function of the disconnector is to stop the hammer even though the trigger is still pulled, preventing the hammer from immediately following the slide or bolt.

The term "Driver" is a part in a mechanism that receives power directly and transmits motion to other parts.

The term "Tongue" refers to a lateral projection plate to serve as connector or support.

The term "Charge" refers to the action required to load a new cartridge into the chamber of the firearm barrel and close the breech, leaving the weapon in a condition ready to fire.

The term "Supporting hand" refers to the hand supporting a rifle at the front close to the muzzle.

The term "Controlling hand" refers to the hand grabbing a rifle at the rear handle and pulling the trigger.

The term "Breechward" is a direction towards the breech of the rifle.

The term "Muzzleward" is a direction towards the muzzle of the rifle.

The term OEM means Original Equipment Manufacturer.

The terms Rod and Push-Pull bar are used indistinctively.

Terms such as "under," "over," "in front of," "the back of the gun," or "behind," "anterior," "posterior," "downward," "upward," or "transverse," are used here as somebody firing a gun would understand them, which is by reference to the longitudinal or firing axis of the barrel when the gun is held in the usual horizontal attitude.

The term "Slide Action" refers to reloading a repeating firearm in which a new round is brought from the magazine into the breech by pulling and pushing a supporting hand, applying motion to the Forend in line with the barrel.

The term Forend Grip and Sliding Hand guard are used indistinctively.

The term Bore is the hollow part inside a tube.

The term Flange is a projecting flat rim, collar, or rib on an object, serving to strengthen or attach to maintain position on a rail or supportive structure A polygonal chain, in geometry, is a connected series of line segments. More formally, a polygonal chain may also be called a polygonal curve. Every nontrivial monotone polygonal chain is open.

A polygonal Line can be defined as a geometric object "consisting of a number of points (called vertices) and an equal number of line segments.

A concave polygon, the polygon is concave if all of its interior angles must be more than 180 degrees.

A polygon is open when the segments do not all connect at the beginning and end. That is, if we draw the polygon starting at one point, we finish drawing at a different point.

A polygon is closed when the segments do connect at the beginning and end. That is, you start to draw the line at a point and finish at the same point.

A ground is a nominally rigid body that acts as the reference for all motions of the other bodies, and attached to it is the power input device, usually a motor, and another joint.

Structurally, Ground or Grounded means temporarily mechanically affixed to a main member receiver or barrel of the firearm in a manner that it cannot move relative to it.

Bending is the curvature that appears in a beam or column when a load is applied perpendicular to the long axis of a beam/column. The load causes the beam/column to bend hence the name.

Buckling is a form of failure when the beam or column is subjected to an axial load which exceeds its tensile strength parallel to its long axis.

Buckling and bending may be present in the failure of a bar when loaded axially like a column, such as the case of the rod part number (80). In all previous Slide Action used in the past, especially when the ratio bar diameter/bar length is very small, sometimes the bars or plates presented Buckling.

Buckling and bending occurs abruptly when a big axial load is applied to a slender bar, where the slender bar is as well possible subject of vibration.

In 1757, Euler derived a formula that gives the maximum axial load that a long, slender, ideal column can carry without buckling. An ideal column is one that is perfectly straight, homogeneous, and free from initial stress. The maximum load, sometimes called the critical load, causes the column to be in a state of unstable equilibrium; that is, the introduction of the slightest lateral force will cause the column to fail by buckling.

INVENTION FIELD

This invention generally relates to a firearm having a collection of mechanisms and arrays, and subassemblies conceived to ease the use, manufacturing and installation of Slide Action operating system in firearms by cancelling the gas action operating systems, and substituting them by a mechanical slide action, in a manner that, the invention can be implanted into existing semi-automatic gas operated rifles, or into rifles in future production conserving entirely all the shapes, firing mechanisms, receivers, barrel and external shapes.

This flexible solution allows manufacturers to offer an alternative solution to quickly respond to market demands trends without incurring in costly modifications in the production lines.

Pervious individual Rifle owners can adapt their gas actuated firearms by suspending the semi-automatic feature, and easily become legally compliant by reducing the rate of fire to that of a hand operated action. The modular design of certain firearms like AR 15 make possible to exchange the entire Upper receiver and barrel subassembly in less than a minute. Many shooters own several uppers with different barrel types for diverse uses.

Firearm experts define a slide action rifle or shotgun as one in which the handgrip can be pumped back and forth in order to eject a spent round of ammunition and to chamber a fresh one. It is much faster than a bolt-action and somewhat faster than a lever-action, as it does not require the trigger hand to be removed from the trigger whilst reloading. When used in rifles, this action is also commonly called a slide action.

With a Slide-Action firearm, the action is manually operated by a movable forend that goes manually driven backwards and forwards to eject, extract, and chamber a round of ammunition. Pump-actions are usually associated with shotguns, but several examples of a pump-action rifle is the Remington Model 7600 series, the Remington 7615P in .223 Rem. Pump action firearms are largely insensitive to ammunition quality and therefore provide outstanding dependability.

The first slide action patent was issued to Alexander Bain of Britain in 1854. Modern pump-action designs are a little slower than a semi-automatic shotgun, but the pump-action offers greater flexibility in selection of cartridges, allowing the shooter to mix different types of loads and for using low-power or specialty loads.

Semi-automatic rifles must use some of the energy of each round fired to cycle their actions, meaning that they must be loaded with shells powerful enough to reliably cycle. The slide action avoids this limitation. In addition, like all manual action guns, pump-action guns are inherently more reliable than semi-automatic guns under adverse conditions, such as exposure to dirt, sand, or climatic extremes. Thus, until recently, military combat shotguns were almost exclusively pump-action designs.

Recent Trends

Recently new patents have been issued like Troy, US 20150089854 A1; and David Finlay, US 20150089854 A1, and assigned to Smith & Wesson developing pump action rifles having an external appearance or looking similar to the very popular AR 15 semi-automatic rifles, but in both cases the bolt carrier, and incorporated bolt locking mechanisms are internal to the receiver, within a by design receiver, and is completely different than the OEM mechanism of the famous AR 15. The action lock mechanism and action takes place inside the receiver of the firearm. A more recently awarded patent is number U.S. Pat. No. 9,638,481 of 2017 May 2 awarded to Frank Marrano, achieves similar results. However the mechanism is completely unlike and differs drastically from this Application in the fact that The Sliding Locking Mechanism, though it is external to the OEM receiver, it differs in many ways like surrounding the barrel entirely, and in turn, surrounded by external hand guards mechanism with a locking device, which in turn makes it very internal and complicated. Many more differences exist, The present invention Application, in opposition, advantageously maintains all the OEM internal mechanisms of the AR 15 intact inside the lower receiver, without any alteration, preserving the integrity of both the original AR 15 upper and lower receiver, it only adds and substitute components, external to the upper receiver, in a manner in which any conventional AR 15, M4 or HK 416, or M16 or SIG 516 may be converted into a slide action only, depriving it from the semi-automatic gas operation in order to comply with some States regulations which ban the sales, possession and operation of semi-automatic rifles of the Semiautomatic category.

Applicant has been involved in the topic of providing innovation to the use of combined simultaneous operation of sub automatic gas operated systems, and manually actuated slide actions mechanisms. Many of the used parts in said developments are used valuably in the present invention application, like supports, A protective structured guiding tube and several more.

The relevant work is noticeable in PPA patent of 61/686,226 filed on Apr. 2, 2012; then converted into U.S. Pat. No. 9,188,401 B2; followed by patent application Ser. No. 14/944,203, filed on Nov. 17, 2015, still in the prosecution process in the RCE status.

The present Application is a more specific development to provide solutions to new circumstances involving the possible trends related to legal regulations related to firearms acquisitions and ownership of semi-automatic rifles.

Some parts and concepts herein presented have been inherited from the applicant's previous inventions, like for example the use of an external structural protective tube guide (70) to strengthen and protect from Buckling the slender action push-pull bar (80) always needed in all Slide Action mechanisms.

BACKGROUND, PRIOR ART

Slide Action mechanisms for firearms applications are old. The first slide action patent was issued to Alexander Bain of Britain in 1854.

Older pump-action shotguns are often faster than modern semi-automatic shotguns, as they often did not have a trigger disconnector, and were capable of firing a new round as fast as the pump action was cycled, with the trigger held down continuously. This technique is called a "slamfire", and was often used in conjunction with the M1897 in the First World War's trench warfare.

Modern pump-action designs are a little slower than a semi-automatic shotgun, but the pump-action offers greater flexibility in selection of shot shells, allowing the shooter to mix different types of loads and for using low-power or specialty loads. Semi-automatic shotguns must use some of the energy of each round fired to cycle their actions, meaning that they must be loaded with shells powerful enough to reliably cycle. The pump-action avoids this limitation. In addition, like all manual action guns, pump-action guns are inherently more reliable than semi-automatic guns under adverse conditions, such as exposure to dirt, sand, or climatic extremes. Thus, until recently, military combat shotguns were almost exclusively pump-action designs.

Melvin Johnson invented the M 1941 rifle conceived a short rotary bolt. The rifle he designed was a short-recoil system with a multi-lug rotating bolt (which was the direct ancestor of the AR bolt design of E. Stoner) similar based breech closing systems are present in numerous modern rifles.

General Advantages of Slide Action in Rifles.

The cycling time of a slide action or pump-action is quite short. The manual operation gives a pump-action the ability to cycle rounds of broadly varying power that a gas or recoil operated firearm would fail to cycle. The simplicity of the pump-action relative to a semi-automatic design also leads to improved durability and lower cost. It has also been noticed that the time taken to work the action allows the operator to identify and aim on a new target. All the advantages of Slide Action shotguns are applicable to Slide action rifles. Others herein claimed for rifles, like the ones that are related to the position of the locker mechanism at the forend, nested in the slider forend, which is claimed in the present application are applicable to shotguns.

An advantage of the pump-action over the bolt-action is its ease of use by both left- and right-handed users: like lever-actions, pump-actions are frequently recommended as ambidextrous in sporting guidebooks. However, most are not truly ambidextrous, as the spent casing is ejected out the side in most designs.

General Disadvantages of Slide-Action Reloading

The first application of the slide action operation was for shotguns, and is mentioned here to highlight that the addition and removal certain features has improved to be safely used now in rifles. A disconnector mechanism was added. The Lifter mechanism was suppressed for rifles, and removable magazine feature to fed, were installed, permitting the use in rifles.

Like most lever-action rifles, most slide-action shotguns and rifles do not use a detachable magazine, most use a tubular magazine. This makes for slow reloading, as the cartridges have to be inserted individually into the firearm. However, some slide action shotguns and rifles, such as the Russian Zlatoust RB-12, Italian Valtro, and the American Remington 7600 series use detachable box magazines.

The Magazine tube under the barrel serves as a guide for sliding a movable forend for recharging. Nearly all slide-actions shotguns use a back-and-forward motion of the forend to cycle the action. The forend is connected to the bolt by one or two bars; two bars are considered more reliable because it provides symmetric forces on the bolt and pump and reduces the chances of bending, or Buckling.

There are precedents where rifles have been produced in semi-automatic versions and in slide action versions like the well-known family of Remington rifles. However they are well different internally.

Years later Remington evolved to produce a semi-automatic rifle based in the 7600 and produced the M7400 1952-1981 replaced by M750 synthetic 760 pump Action. Recently the 7600 evolved to become a new rifle Remington "7615" Pump Action Rifle which is basically the same 7600 without any semiautomatic features and restrained to be a Slide Action.

This configuration surpasses the legal restrictions imposed by the Australian legislation related to the import, possession and sales of rifles which ban the semi-automatic rifles.

The motion of the bolt, back and forth in a tubular magazine model, will also operate the elevator, which is a separate mechanism that lifts the shells from the level of the tubular magazine to the level of the barrel. After firing a round, the bolt is unlocked by a necessary manual movement of the shooter, and the forend is free to be moved rearwards. The shooter pulls back on the forend to begin the operating cycle. The bolt unlocks and begins to move to the rear, which extracts and ejects the empty shell from the chamber, cocks the hammer, and begins to load the new shell. In a tubular magazine design, as the bolt moves rearwards, a single shell is released from the magazine, and is pushed backwards to come to rest on the elevator.

In Shotguns, as the forend reaches the rear and begins to move forward, at the motion of the shooter's hand, the elevator lifts up the shell, lining it up with the barrel. As the bolt moves forward, the round slides into the chamber, and the final portion of the forend's travel locks the bolt into position. A pull of the trigger will fire the next round, where the cycle begins again.

Most pump-action firearms do not have any positive indication that they are out of ammunition, so it is possible to complete a cycle and have an empty chamber. The risk of running out of ammunition unexpectedly can be minimized in a tubular magazine firearm by topping off the magazine by loading new rounds to replace the rounds that have just been fired. This is especially important when hunting, as many locations have legal limits on the magazine capacity: for example, three rounds for shotguns and five rounds for rifles.

Modern pump shotgun designs, such as the Remington 870 and Mossberg 500, have a safety feature called a trigger disconnector, which disconnects the trigger from the sear as the bolt moves back, so that the trigger must be released and pulled again to fire the shotgun after it closes.

Many early pump shotguns, such as the Winchester 1897, did not have trigger disconnectors, and would, if the trigger were held back, fire immediately upon closing.

Due to the higher rate of fire that this allows, some shooters prefer models without this disconnector feature, such as the Ithaca 37, Stevens Model 520/620, and Winchester Model 12. All the latter named are Slam Action.

NAME OF THE COMPONENTS AND REFERENCE NUMERALS

Part Number Name

10 EXTERNAL TUBE AND STRUCTURE SUPPORT ADAPTING PLATE RING
10A REAR PINS
10B BARREL HOLE
10C ROD BORE
10D STRUCTURAL HAND GUARD SUPPORT HOLES
10A TUBE SUPPORT ADAPTING PLATE
10E CLOSING JAWS
10F SCREW
10G THREADED HOLE JAW
11 TUBE SUPPORTING LUG
11A ANNULAR INSERTION CUT
11B ROD BORE GUIDE
12 BARREL NUT
12A SEMI CIRCULAR CUT
12B HOLE FOR BARREL
13 BOLT CARRIER
13 A BOLT CARRIER BAR COUPLER
13 B ROTARY BOLT
13 C BOLT FRONTAL FACE IN ITS MAXIMUM FORWARD EXTENSION
13 D SCREW TO AFFIX 13 A TO 13 AS A UNITARY BODY.
13 E CONSTANT DISTANCE TO DETERMINE EXACT POSITION OF HOLE 80
13 F CAVITY FOR AFFIXATION OF PUSH-PULL ROD BAR (80) TO 13 A.
14 BARREL
14 A BARREL GAS PORT
14 B AXIS OF THE BARREL
14 C BARREL CHAMBER
14 D LIVE ROUND IN CHAMBER
14 E BARREL SHOULDER STEP
15 MAIN SPRING

16 UPPER RECEIVER
16 A FRONTAL PASSAGE ORIFICES
17 U SHAPE HAND GUARD SUPPORT STRUCTURE
18 LIFE CARTRIDGE
18 A SPENT SHELL
18 B CARTRIDGE MAGAZINE
19 LOWER RECEIVER
31 PUSH-PULL ROD DRIVER
31A LATERAL EXTERIOR PROJECTION POST CONNECTOR PLATE SUPPORT OF DRIVER
31B UPPER RECEIVING HOLE FOR CONNECTOR POST
31C SLIDING CYLINDRICAL ROD CLAMP
31D EXTERIOR ROD DRIVER CLAMP-PIN SCREW MECHANISM
31E CLAMP BORE
31F HOLE FOR CLAMP-PIN SCREW MECHANISM INSERTION
31 G FRONT FACE
31H SCREW HEAD
31 J THREADED ZONE IN SCREW
31 K CONIC ZONE IN SCREW
31 L ROUND PIN ZONE
31 M PIN BED HOLE FOR PIN INSERTION
31 N CONIC BED ZONE IN HOLE
31 P THREADED ZONE OF HOLE TO RECEIVE THREADED SCREW 31D
31 Q AXIS OF ALIGNMENT OF THE VERTICAL HOLE AND THE SCREW 31 H
31 R GAP FOR PRESSURE WASHER
31 S REPRESENTS THE ZONE OF THE CLAMP BORE (31D) RECEIVING THE CLAMPING FORCE EXERTED BY THE 31 K OF THE SCREW WHEN PUSHING
51 UPPER TUBE AND LINKAGE MECHANISM SUPPORT BLOCK
51A SECURING ROD BORE
51B UNDER CUT FOR TUBE SUPPORT
51D BLIND BORE
51E DOUBLE V DOVETAIL MALE
61 LOWER SUPPORT BLOCK
61A BARREL BORE CLAMP/FIXATION FOR FRONTAL MAIN STRUCTURAL STATIONARY HAND GUARD
61C DOUBLE V DOVETAIL FEMALE
61D SCREW HOLES
61E SCREW
65 ALTERNATIVE ONE PIECE SUPPORT BLOCK
65A BARREL BORE CLAMP
65C UNDERCUT FOR TUBE SUPPORT
65D SCREW HOLES
65H UPPER FACE
65 I SCREW
65K REAR FACE
65 J LATERAL LINER UNDERCUTS
68 MAIN AXIS OF LINKAGE CO ALIGNMENT FOR ACTUATOR LINKAGE
70 EXTERNAL STRUCTURAL SUPPORTING GUIDE TUBE
70A ENGAGING GROVES/SLOT CUT
70B FORE END
70C REAR END
70D LOCKING PROTRUSIONS
70E INTERNAL WALL OF TUBE
80 PUSH-PULL ROD ACTUATOR
80A FORE END/AFFIXING SURFACE
80B REAR END/AFFIXED TO BOLT CARRIER
80C CYLINDRICAL RING
80D CYLINDRICAL RING FRONT FACE
80 E THROUGH HOLE FOR THE PASSAGE OF PIN SCREW
80 F EFFECTIVE CIRCULAR AREA SECTOR OF ROD AT THE A-A' SECTION CUT
90 COMPRESSION SPRING
94 FRONTAL MAIN STRUCTURAL GROUNDED STATIONARY HAND GUARD
94A CHANNEL GUIDE
94B THROUGH CUT GROUNDED WINDOW
94 C REAR CONNECTING SURFACE
94 D FASTENING HOLE
94 E FASTENING HOLE TO AFFIX WITH 61 OR 65
94 F SCREW TO AFFIX WITH 61 OR 65
94 J FLANGE TO COUPLE WITH 65 J
94 K AXIS OF ALIGNMENT OF THE STRUCTURAL STATIONARY HAND GUARD BEAM
95 EXTERNAL SLIDING HANDGUARD OR MOBILE FOREND
95A CHANNEL GUIDE
95B THROUGH CUT MOBILE WINDOW
95C HOLES TO HOUSE PIVOTING PIN
96 (EXTERNAL TO THE RECEIVER) LOCK ACTION LOCKING LEVER ARM
96A PIVOT PIN HOLE
96B LOWER RECEIVING HOLE FOR CONNECTOR POST
96C PIVOT PIN. ONE ONLY, TRAPPED BETWEEN 2 PARALLEL SIDES OF 94
96D LEVER ARM SPRING
96E EXTERNAL LOCK ACTION RELEASE PUSH BUTTON
96F LOCK ACTION INTRUSIVE LUG (PROJECTION)
96G WINDOW THROUGH CUT
97 EXTERNAL CONNECTING MEANS OF SLIDING HAND GUARD GROUP TO DRIVER CONNECTOR POST
98 COMPLETE FIRING MECHANISM WITH DISCONNECTOR
98 A TRIGGER
98 B HAMMER

FIGURES DESCRIPTION

As an example of the multiple rifles which can accept the parts array pertinent to the present application, all parts described in the following Figures Description, pertain to an AR-15 standard rifle platform.

FIG. 1 Shows the External Tube support adapting plate (10) and its features, which is a multipurpose part to create a quick first means of support and constrain between the Upper Receiver (16), and the Exteriorly mounted frontal main grounded stationary hand guard (94); and the structural supporting guide tube (70). In this particular case the described adapting plate can be used for an AR 15 rifle, as an example.

Figure 2:
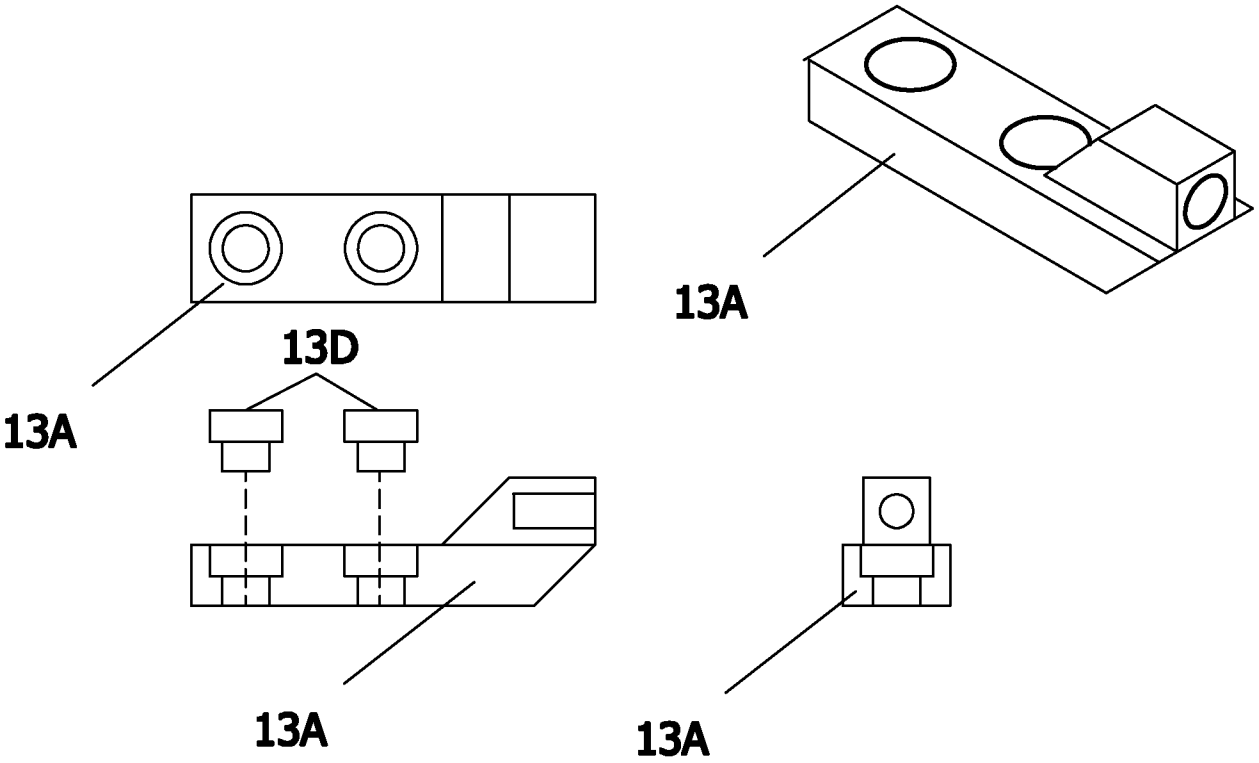

FIG. 2 Shows an orthographic view of Bolt Carrier Bar Coupler (13A) and its features, which is a multipurpose part that serves as connection means between the Bolt Carrier (13) and the Push-Pull Rod actuator (80) and other parts affixed to it. The cavity (13F) explicitly shows the place where the rear end (80 B) of the Push-Pull Bar (80) is permanently affixed in a manner that they become one solid undetectable body. The bodies are subsequently shown as independent bodies for illustrative fabrication descriptive reasons only. Welding of the parts is a preferred method of fabrication to avoid any potential rotation of the bar (80) relative to the Bolt Carrier Bar Coupler (13A). The latter condition is essential in order to guarantee that the hole (80D) runs horizontal and transverse relative to the main axis of linkage co alignment for the actuator linkage (68), as later explicitly shown in FIGS. 4, 7, 7A, 12, 13, 19A, 21.

Figure 3:
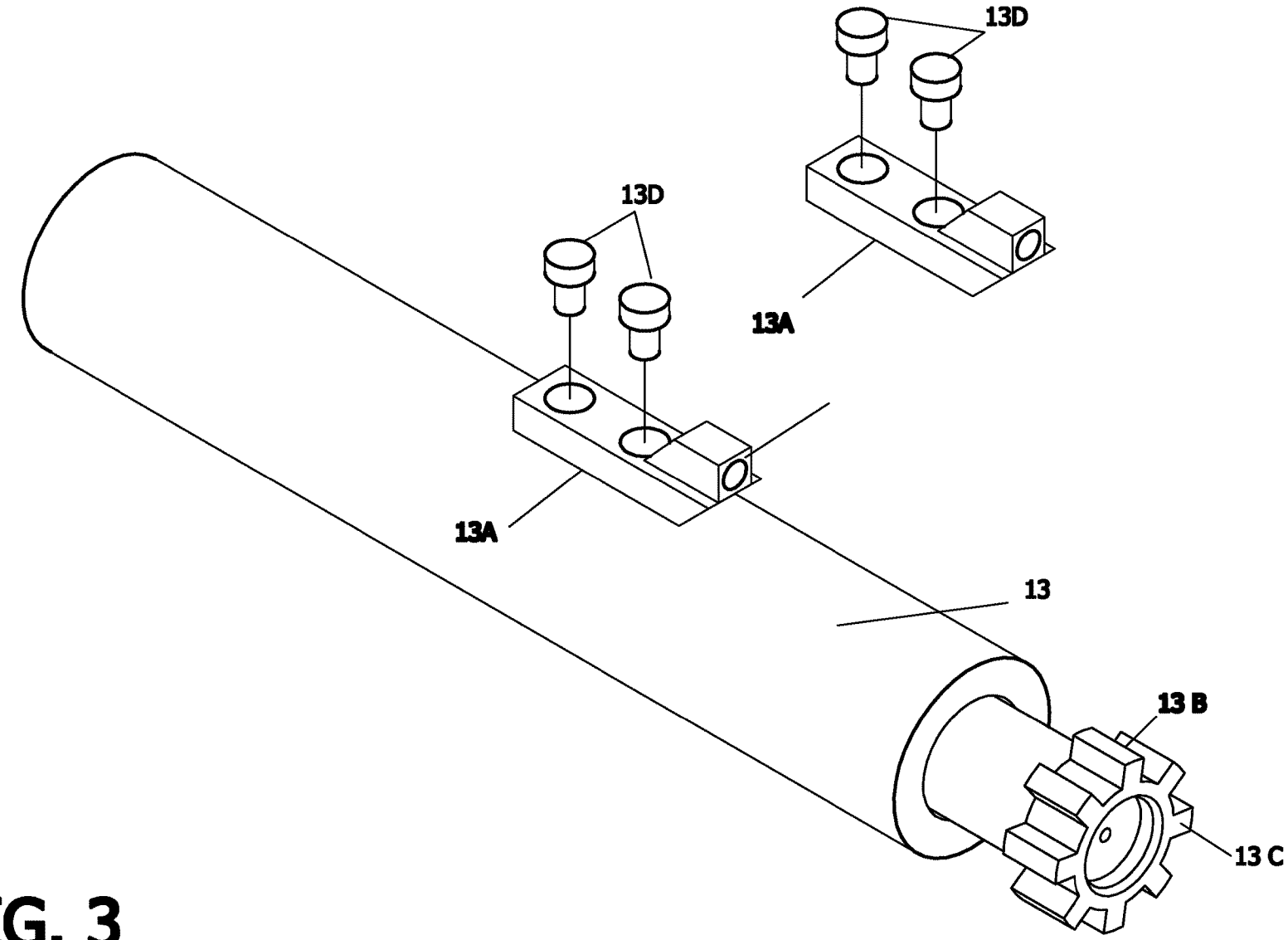

FIG. 3 Shows an isometric view of the Bolt carrier (13) with its features with the Bolt Carrier Bar Coupler (13A) affixed. This seals the gas and dirt entrance to the bolt pneumatic system. In a preferred embodiment, parts (13), and (80) are permanently affixed to become one solid piece.

Figure 4:
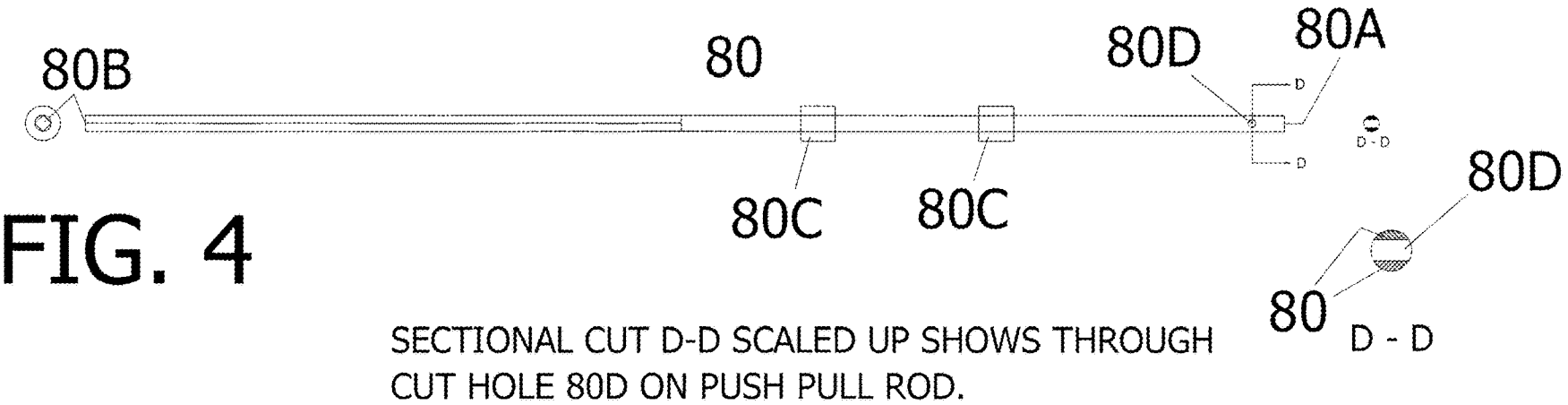
Figure 21:
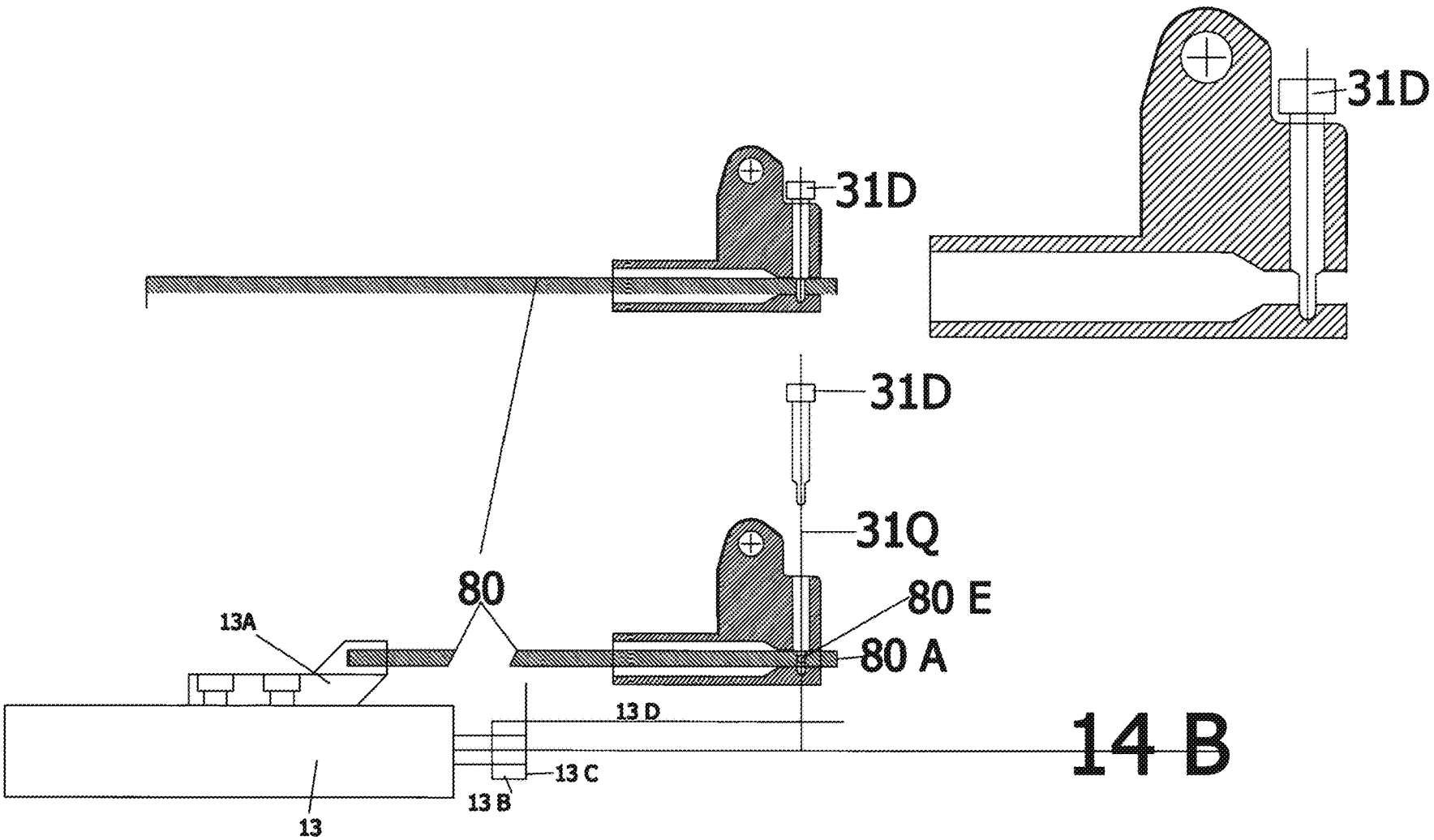

FIG. 4 Shows a lateral and front view of the PUSH PULL ROD ACTUATOR (80). This part may couple permanently with the-bolt carrier bar coupler (13A) at the rear end (80B), integrating a sole unit, and at the front end (80) couples temporarily by the proper fixation means with the push-pull cylindrical rod driver (31) and its features, as shown in FIG. 21. In a preferred embodiment Notice the presence of Rings (81C) around the PUSH PULL ROD ACTUATOR (80), and a through hole cut (80D), through which a Round Pin Zone (31 L) of the Clamp Screw (31 D) may penetrate transversally securing the tight union of the Driver (31) with the push pull rod actuator (80).

Figure 4A:
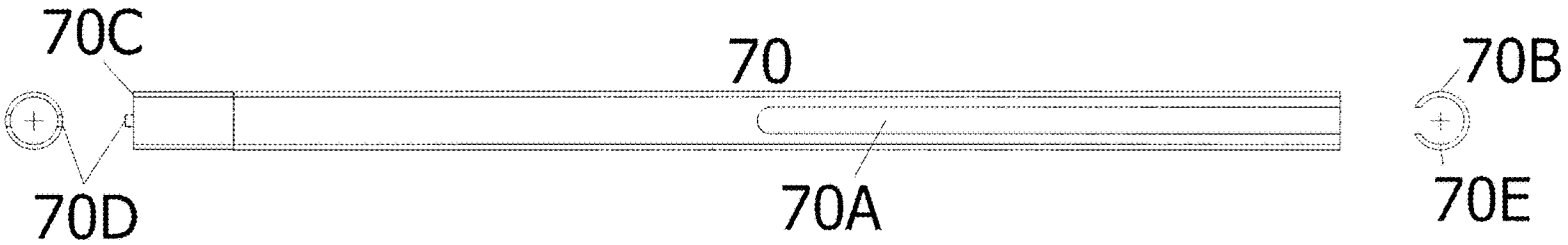

FIG. 4A Shows a lateral and front view of the Structural Supporting Guide Tube (70) and its features, which couples at the rear with the Tube Support Adapting Plate as a means of support. This part serves also to provide protection and alignment to the linkage mechanism moving linearly only through the TUBE 70. The Cylindrical Rings (80 C) to prevent Buckling and Bending are shown.

FIG. 5 Shows a lateral, front view and orthographic view of the LOWER SUPPORT BLOCK (61), which solidly attaches to the barrel to serve as means of support and quick attachment to the Upper Tube and Linkage Mechanism Support Block (51). This part locates in a position atop of the barrel gas port (14A) to block the flow of combustion hot gases, which normally actuates the semiautomatic operation of the firearm. This part also serves as the frontal means of support to barrel (14), and to the Exteriorly mounted Frontal Main Stationary Structural Hand Guard (94)

Figure 6:
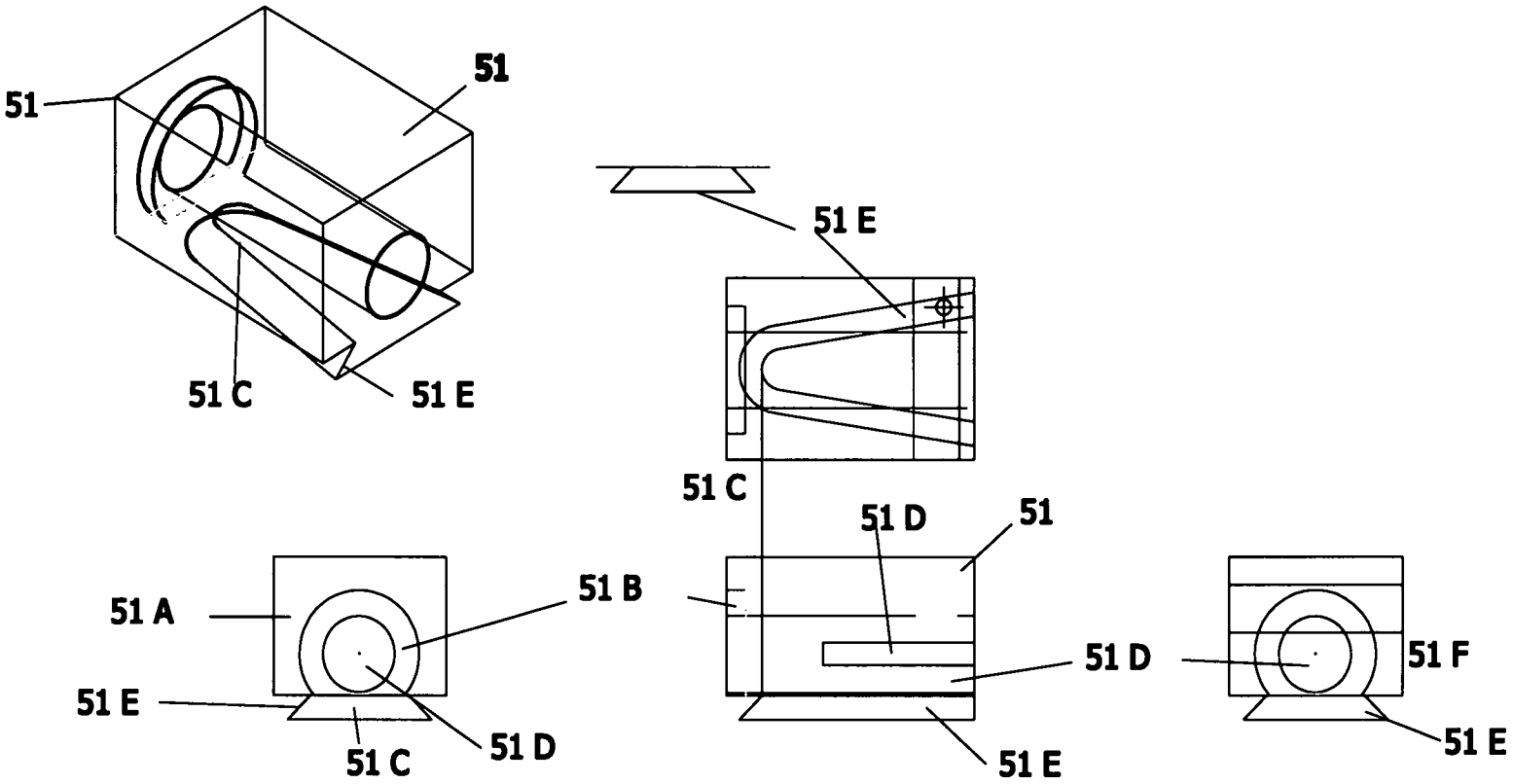

FIG. 6. Shows a lateral, front view and orthographic view of the Upper Tube and Linkage Mechanism Support Block and features, which solidly slides and couples into the Lower Support Block, to serve as frontal means of support to the Structural Supporting Guide Tube. The quick attachment feature facilitates the disassembly and the cleaning of the mechanism.

Figure 7:
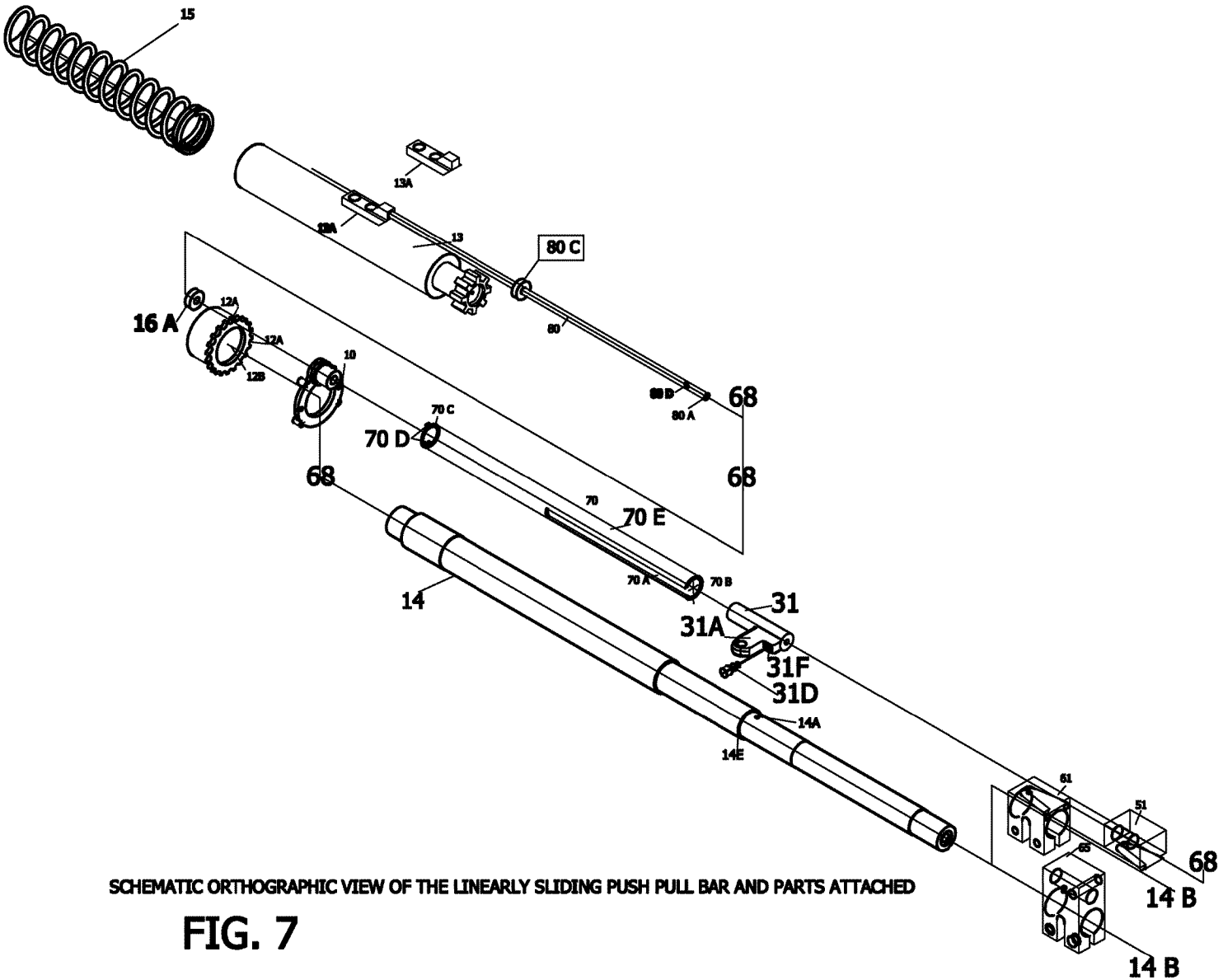

FIG. 7 Shows a schematic isometric view of the assembly of the linearly sliding push-pull bar and parts attached, as well as the structural tube support and its means of fixation to the receiver and the barrel. This array grants a solid alignment of the supporting means and to the moving parts along the axis of alignment (68), and the axis of the barrel (14 B). The main recovery screw (15) may not be mounted when installing the Slide Action set of mechanisms, FIG. 7A. Shows a schematic isometric view of the assembly of the linearly sliding push pull bar and parts attached. All parts become "solid", with zero degrees of freedom motion relative to each other. This set of parts altogether constitute the "Internal Sliding Action Subassembly".

Figure 8:
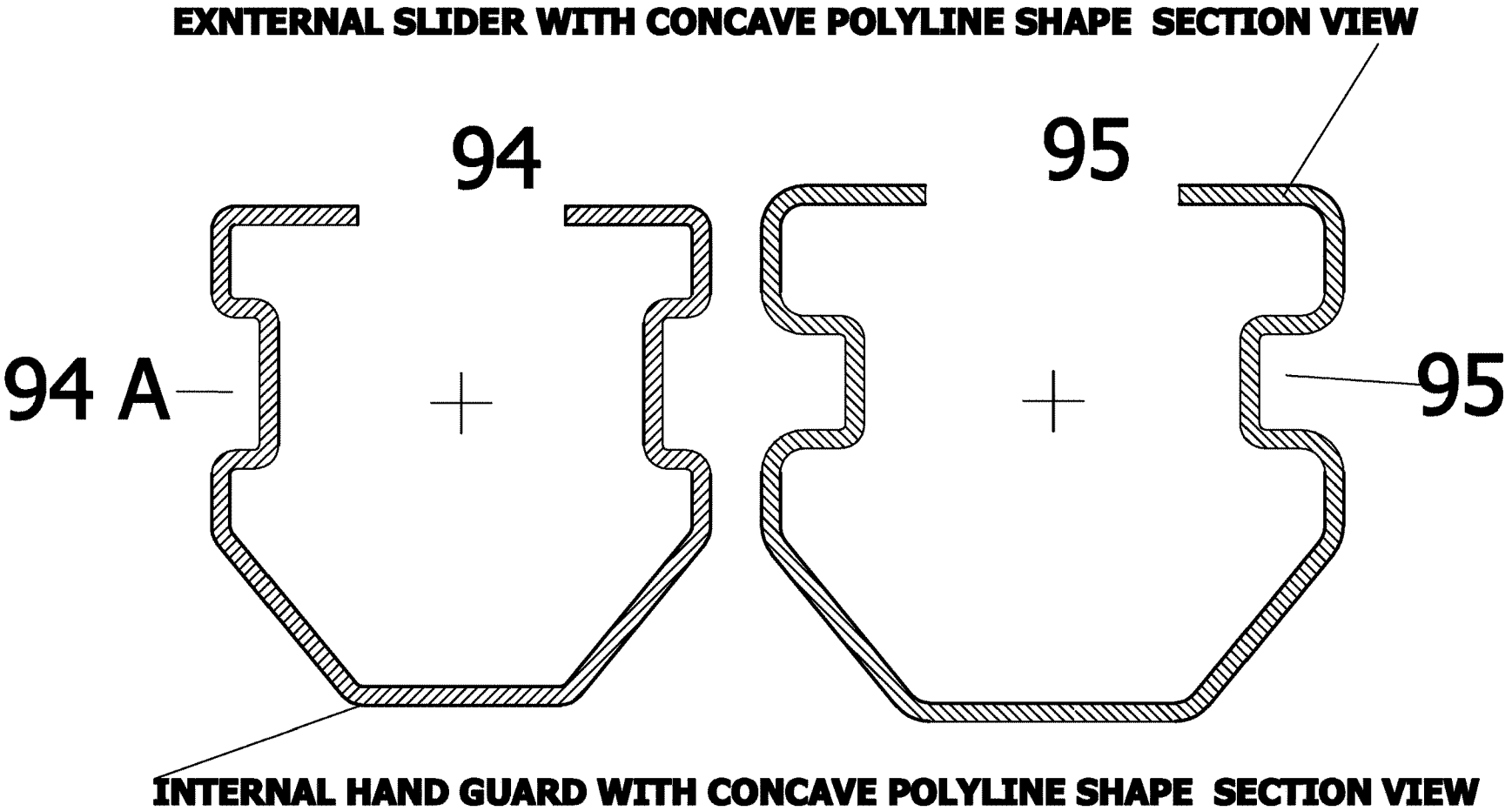

FIG. 8. Shows as an example, the sectional view of the open, concave, symmetrical, polygonal line that is conceived in this application to be used as a sectional shape that enables the mounting of the Exteriorly mounted hand guard (94) to serve as grounded structural beam with the channel guide (94 A) to enable the longitudinal sliding of the sliding forend (95). The multi segment open polygonal line conveys high structural strength to both of the telescopic fitting parts (94) and (95). Notice that Exteriorly mounted hand guard (94) partially encloses the barrel without touching it.

Figure 8A:
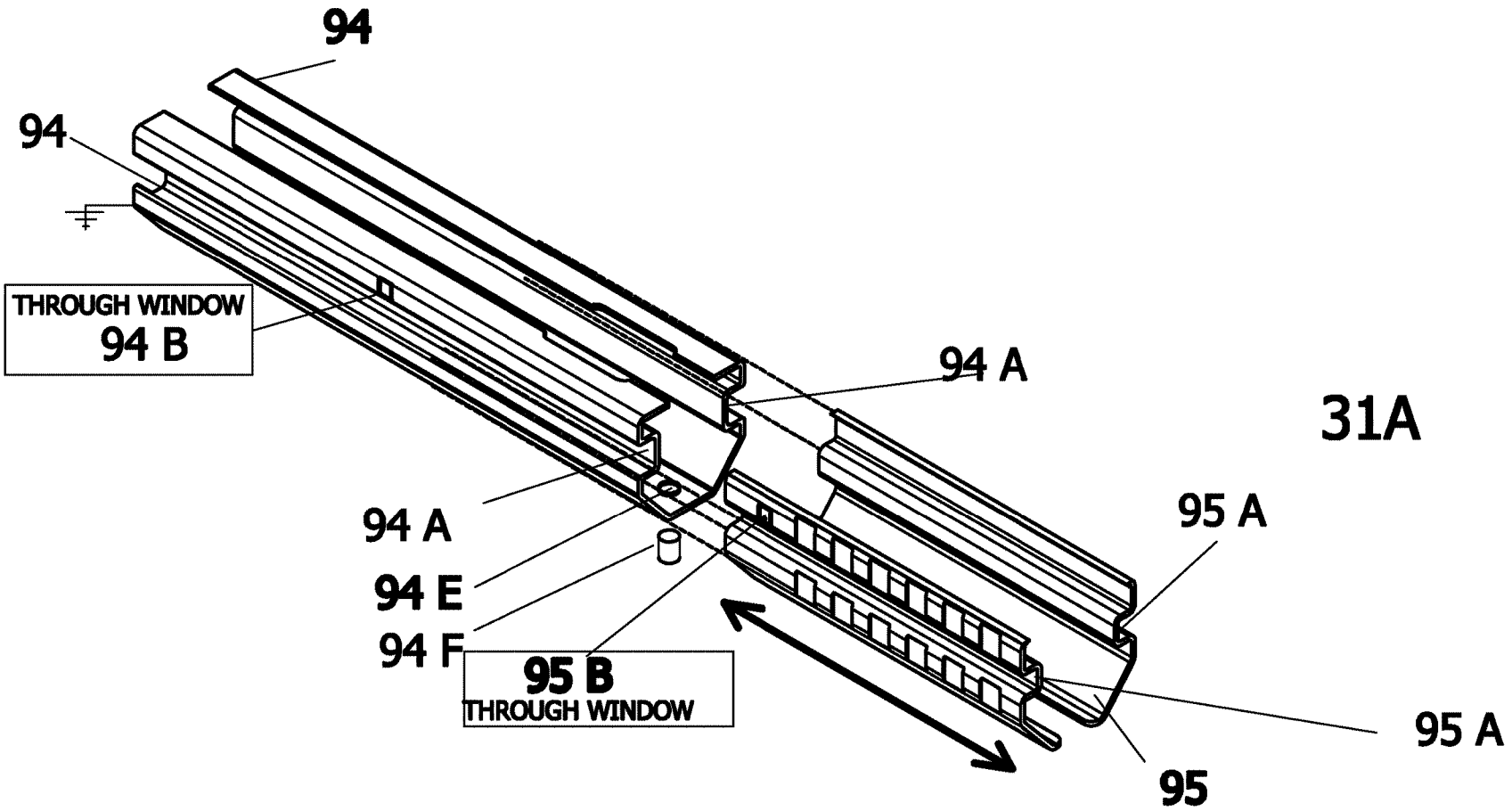

FIG. 8A Shows as an example, an isometric top right view of a set of actuating sliding handguard (95) inserted and sliding over a Exteriorly mounted structural stationary handguard (94) which is grounded to the receiver. Notice the through cut windows (94 B) and (95 B) that will coincide laterally when the sliding hand guard (95) is in the most forward position. Both Latter mentioned parts fit together like a telescopic assembly to provide linear motion only of the actuating sliding handguard (95) relative to the Exteriorly mounted structural grounded stationary handguard (94).

Figure 9:
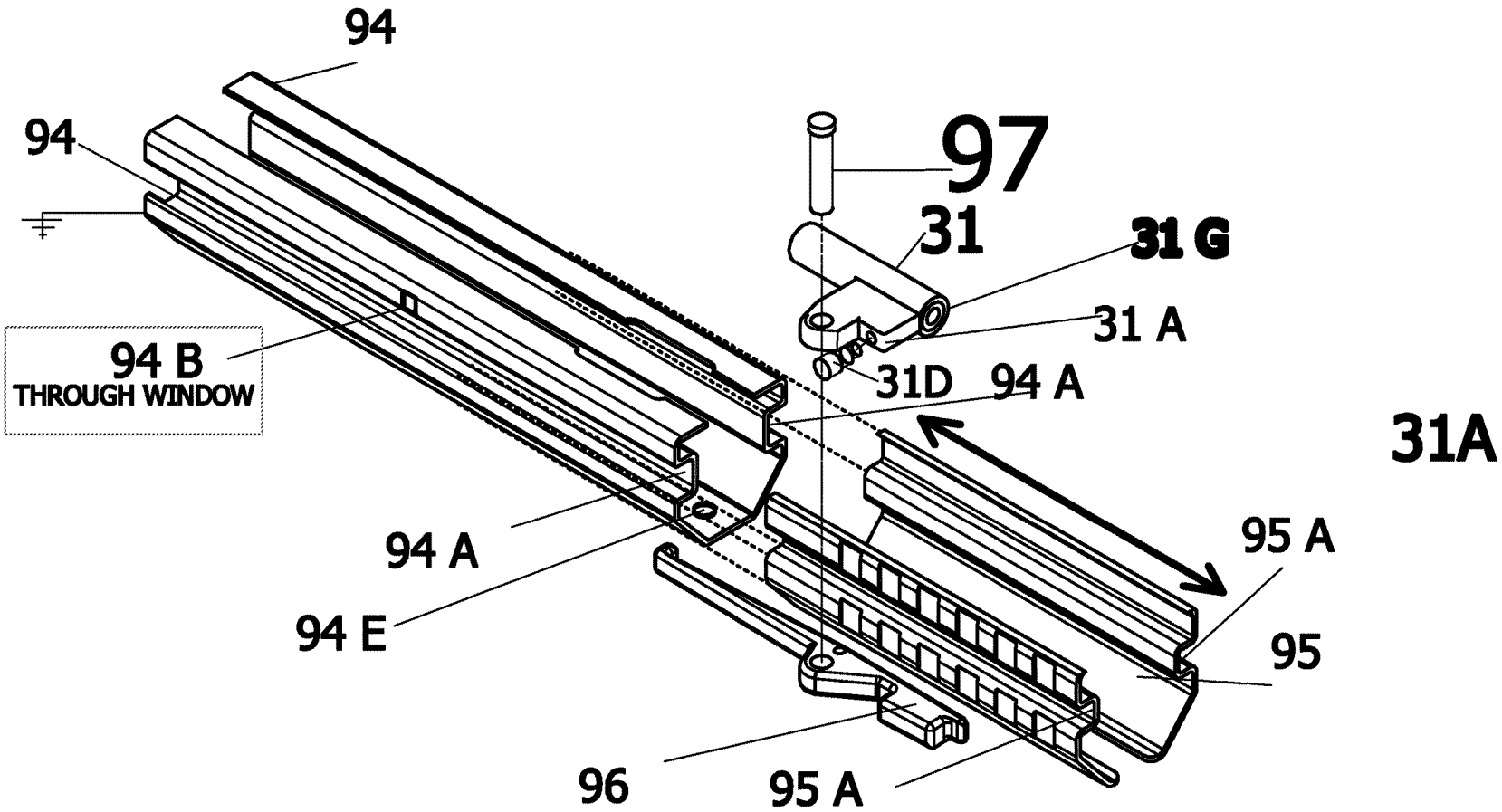

FIG. 9 Shows an isometric top right view of the placement of the locking lever arm mechanism (96) on the linearly sliding Handguard or Forend (95), and the connection with the Rod Driver (95) and parts attached.

FIG. 10 Shows an isometric top right view of the placement of the locking lever arm mechanism (96) on the linearly sliding Handguard (95). Notice the grounding action of pin (96C) coupling the Locking Lever Arm mechanism (96) to the channel guide (95B) by insertion in the pin hole (96A), allowing only the pivoting motion relative to the linearly sliding Handguard (95), in which the lock action intrusive lug portion (96F) penetrates through the window (95B), and when the sliding Handguard (95) is in the most forward position it coincides in position with the through [the] window cut (94B), allowing the complete locking of the linkage. The pin attaches the Pivoting Locker lever (96) to the slider forend (95) and all move linearly assembled relative to the slider forend (95). Important to notice that the Pivoting Locker lever (96) has a pivoting motion of few degrees relative to the revolute pin (96C).

FIG. 10 A. Shows sectional view of how the PIN (96) remains Imprisoned between the channel guides (94 A) and (95 B), The PIN 96 travels linearly freely encapsulated in a two holes (95 C). All the parts when assembled constitute the External Sliding Action Subassembly.

Figure 11:
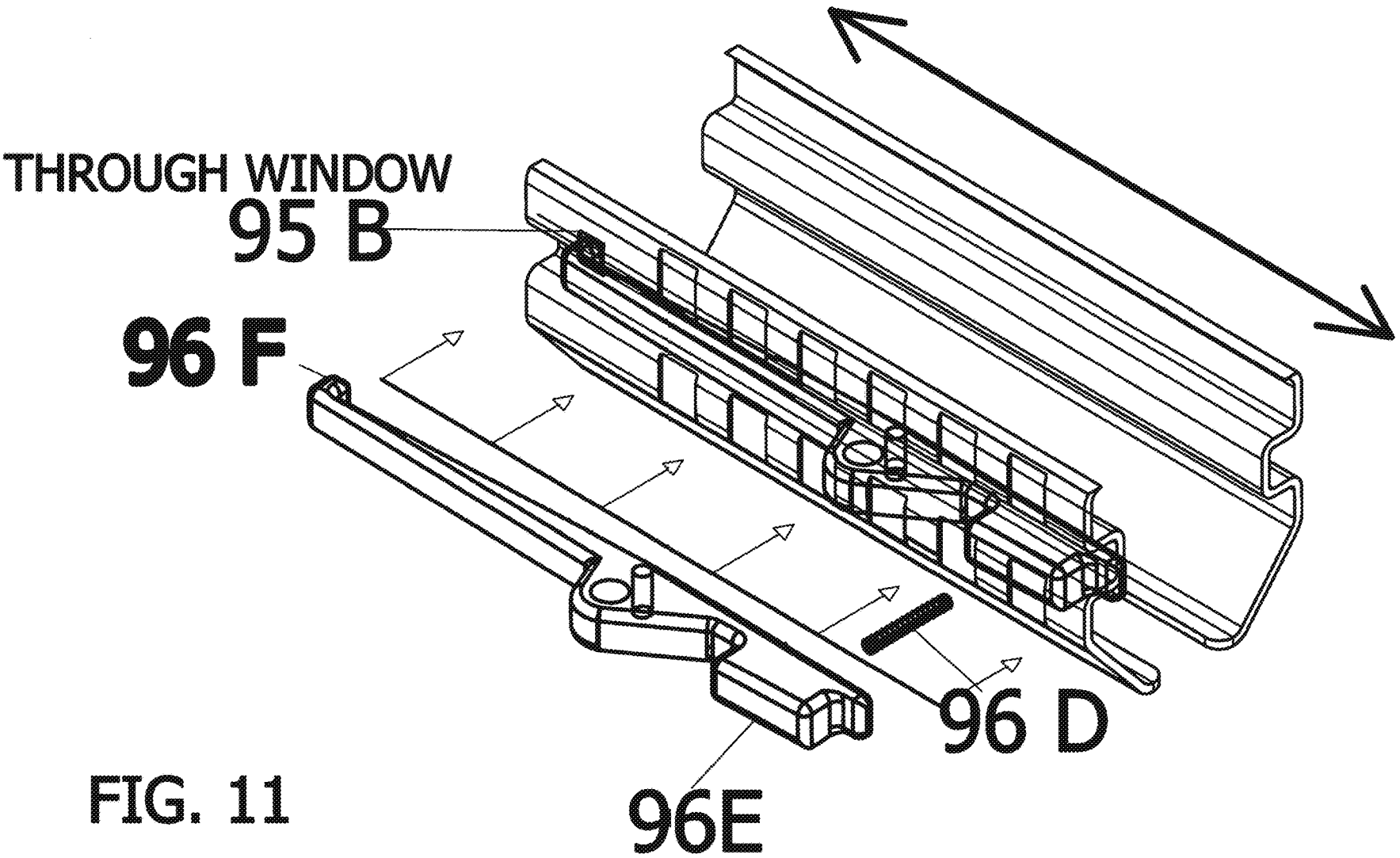

FIG. 11 Shows an isometric top right view of the placement of the Locking Lever Arm mechanism (96) relative to the linearly sliding Handguard (95), and more in particular the housing inside the Channel Guide (95A) through grounding holes in the Channel guide. The compression spring 96 D permanently pushes in a manner in which the lock action intrusive lug portion (96F) is biased towards the window cut (95B).

Figure 11A:
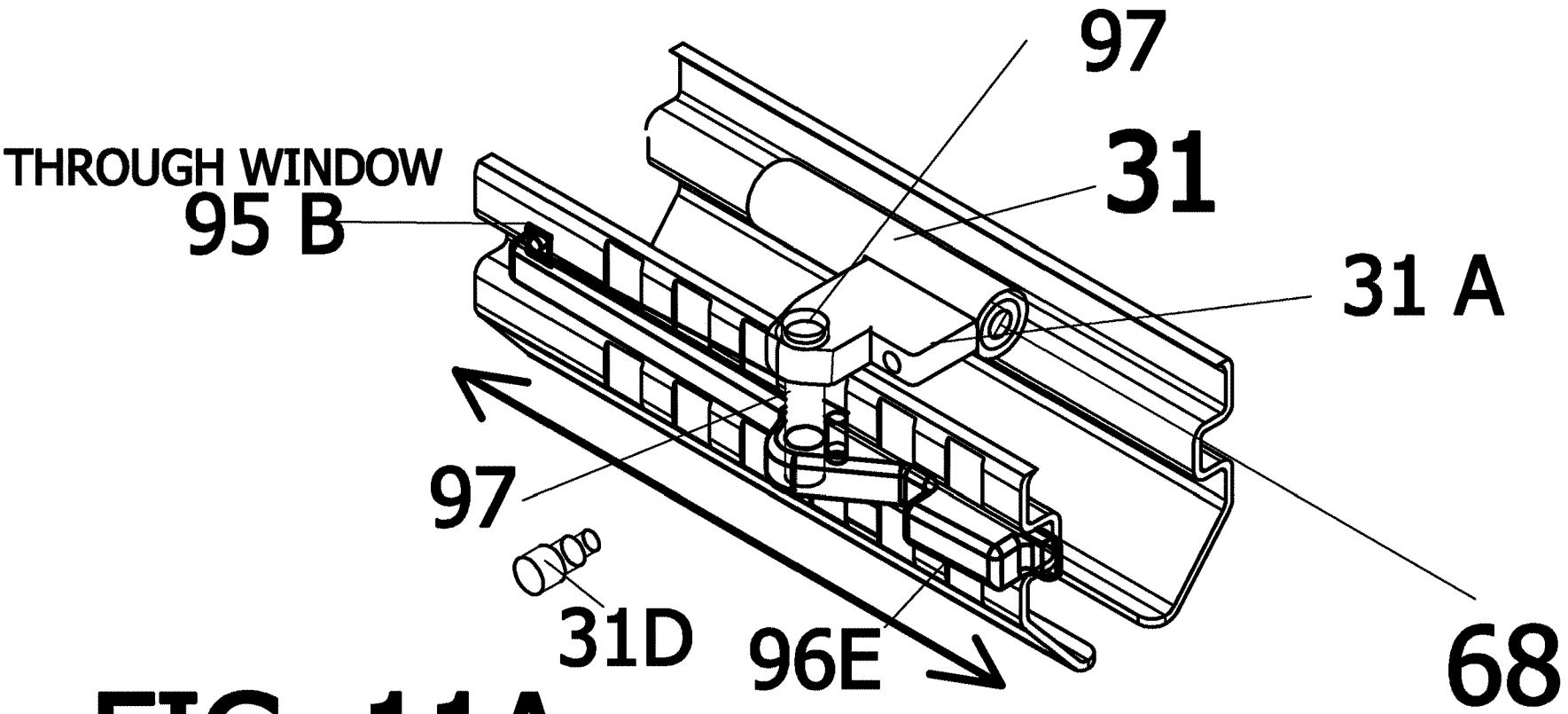

FIG. 11A Shows an isometric top right view of the Locking Lever Arm mechanism (96) already in place, and most importantly, the attachment of the External connector post (97) uniting it to the Rod Driver (31) and parts connected to it. This External connecting action of the post (97) unites the External Sliding Action Subassembly with the Internal Sliding Action Subassembly constituting the Complete Sliding Action Train.

FIG. 11B Shows details of the lever 96. It is attached to the Slider FOREND (95) by a vertical PIN (96 C) and imprisoned by the sliding channel guide (94A), better described in FIG. 10 A. The Lever (96) rotates few degrees around the PIN (96 C), When depressing the spring loaded surface 96 E, the Lock Action Intrusive Lug (96F) pivots about the PIN (96C) few degrees, and pulls out of the interference sliding locking position through cut window (94 B), thus enabling the Pull-Push Manual sliding action concerning to the External To The Receiver Locking Action objective of the present patent application.

Figure 12:
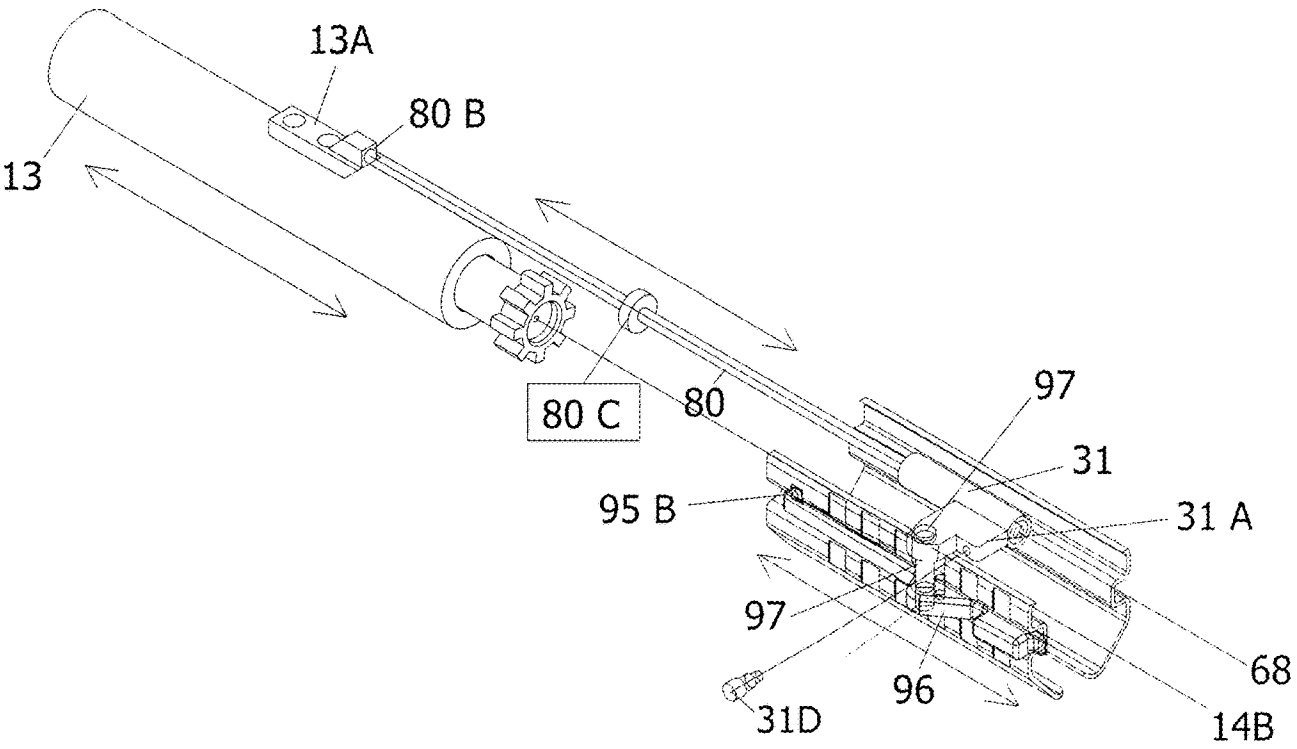

FIG. 12 Shows a schematic isometric top right view of the of the assembly of the linearly sliding push-pull bar and parts attached, and how it is connected, by means of the External Connector Post (97), to the Sliding handguard (95) and Locking Arm subassembly (96), conforming a unit of linearly displacing parts with Zero degrees freedom relative to each other. The external connector post (97) joints parts moving along two parallel axis of motion (68), and (14 B). This schematic constitutes The Complete Sliding Action Train The External Connecting Action of the post (97) unites the External Sliding Action Subassembly with the Internal Sliding Action Subassembly constituting the Complete Sliding Action Train.

Figure 12A:
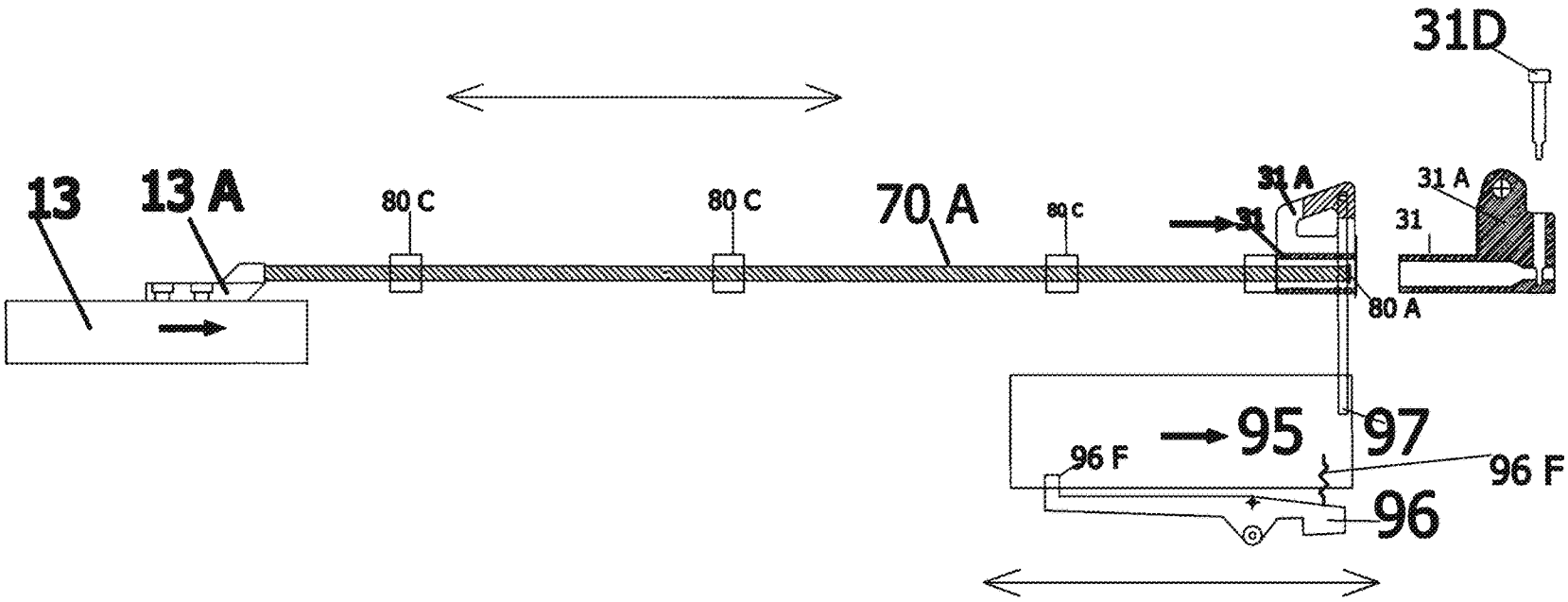

FIG. 12A Shows a schematic view of the of the assembly of the linearly sliding push pull bar (70) and parts attached, displacing along axis 68, joined by connector pole (97) to the exterior sliding hand guard (95), and Exterior Locking Arm assembly (96) displacing along axis 14B.

All parts shown conform a rigid set of parts, like a Solid Subassembly; with Zero degrees of motion relative to each other. All behaving like a solid unit wherein all parts move linearly in the same direction, at the same speed. The only part that has any motion relative to the rest of parts of the assembly is the Locking Lever (96) which is allowed to rotate few degrees relative to the pivot pin (96 C).

The entire subassembly shown in this drawing is also referred as the "Sliding Action Subassembly Train" or "Train of Action" in this application. Notice that all the parts constituting the modification array of parts move and are placed externally to the receiver and do not alter the existing firing mechanism of the existing firearm, nor they move surrounding the barrel or internally to any hand guard.

Figure 13:
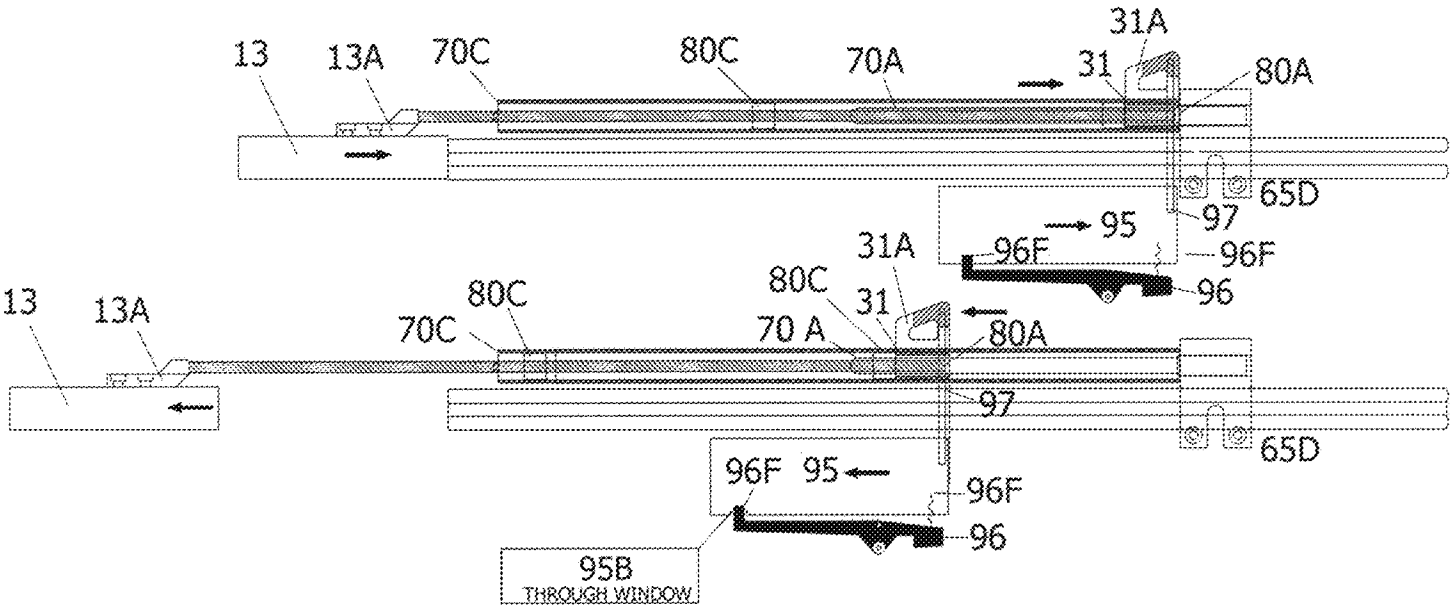

FIG. 13 Shows a schematic view of the linearly sliding push pull bar and parts attached and exteriorly connected and locked to the linearly sliding hand guard (95) to perform the pump action charging action. It shows the comparative positions of the Sliding Train of Action, in both the most forward position in battery, and in the most rearwards position with the totally open bolt. Important to notice is the presence of the Structural Supporting Guide Tube (70) through which the Push-pull bar (80), the rings (80 C), and the driver (31) move linearly in a parallel path along the axis (68), parallel to the axis of the barrel (14B).

Figure 14:
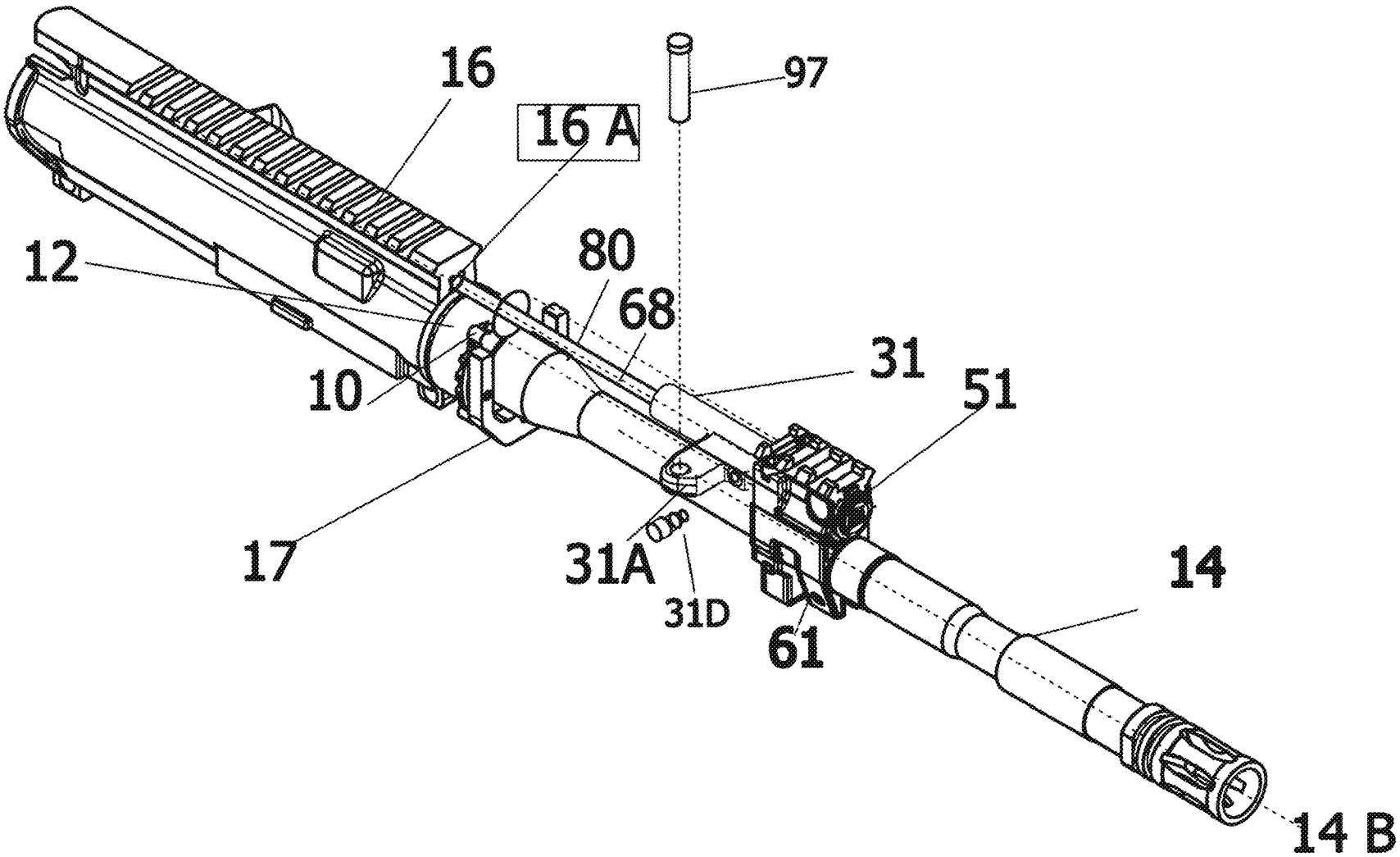

FIG. 14 Shows an isometric top right view of an upper receiver (16) and barrel (14) attached, in which all linearly displacing parts shown in schematic FIG. 7 are realistically shown installed in an Upper Receiver similar to, and wherein the Push Pull Rod (80) actuates partially inside the receiver (16) by passing through the actual frontal passage orifice (16A). Also the structural supporting guide tube (70) is shown in invisible lines, and is supported at the front by the upper tube and linkage mechanism support block (51). To complete the total constraint of the tube, having zero degrees of motion, relative to the receiver (16), and providing ground to all the linkage displacing inside of it. Also is shown the lateral exterior projection Post Connector support (31 A) disposed to receive the connector post (67).

Figure 15:
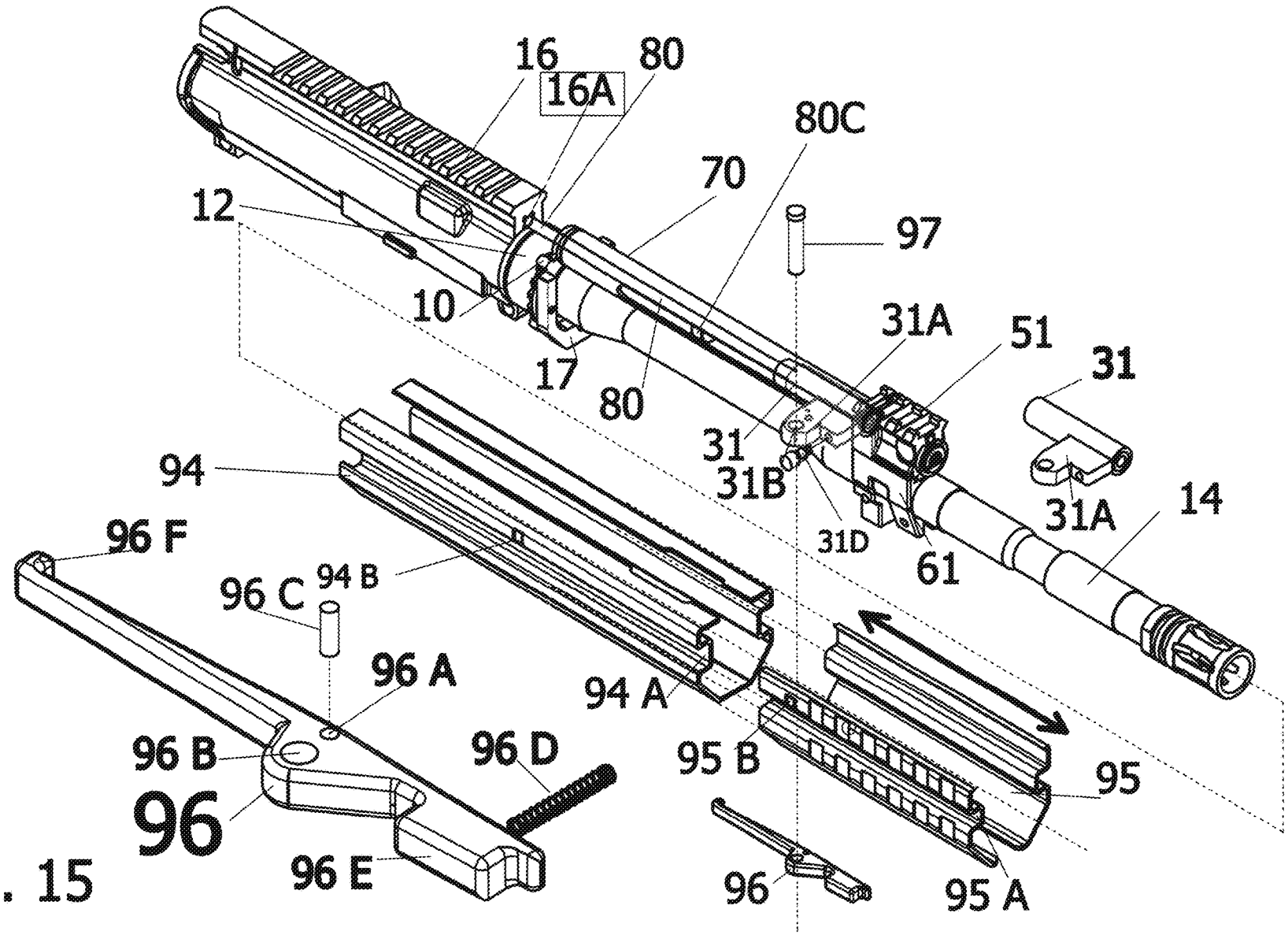

FIG. 15 Shows an isometric top right view of the complete assembly of an upper receiver (16) and barrel (14) attached, with the Exteriorly mounted grounded stationary structural hand-guard (94), and the linearly sliding hand-guard (95) having the lock action locking lever arm Mechanism (96) installed. Important to notice is the coupling of the parts Exterior Tube support adapting plate (10), and the U shape hand guard support structure beam (17). The external shape of the U corresponds exactly to the internal profile of the U shape hand guard support structure beam to which it is affixed. The above mentioned joint of the parts, provides grounding, constraint, solidity to the stationary structural hand-guard (94), and parts connected to it.

Figures 16, 23:
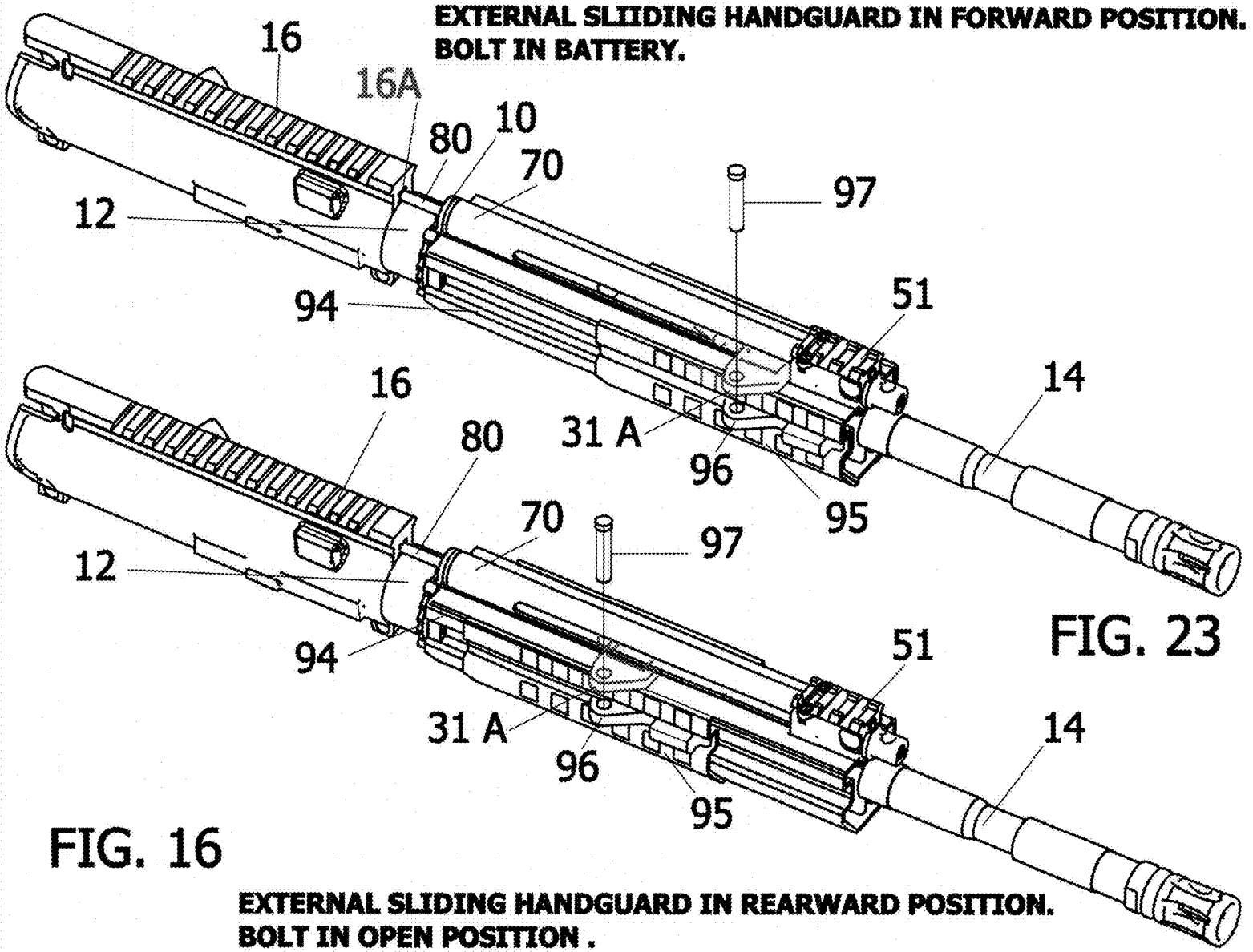

FIG. 16 Shows an isometric top right view of a complete upper receiver and barrel with both hand-guards and locking mechanism installed in. Shown with the external sliding hand guard (95) in rearward position. Bolt in open position. Notice that the function of the part Post Connector (97) is to link The External Sliding Action Subassembly, as depicted in FIGS. 10, 11, 11A with The Internal Sliding Action Subassembly, as depicted in FIG. 7 conforming The Complete Sliding Action Train, which is the union of the latter two Subassemblies as depicted in FIG. 12, 12 *a*, FIG. 13, FIG. 17

Figure 7A:
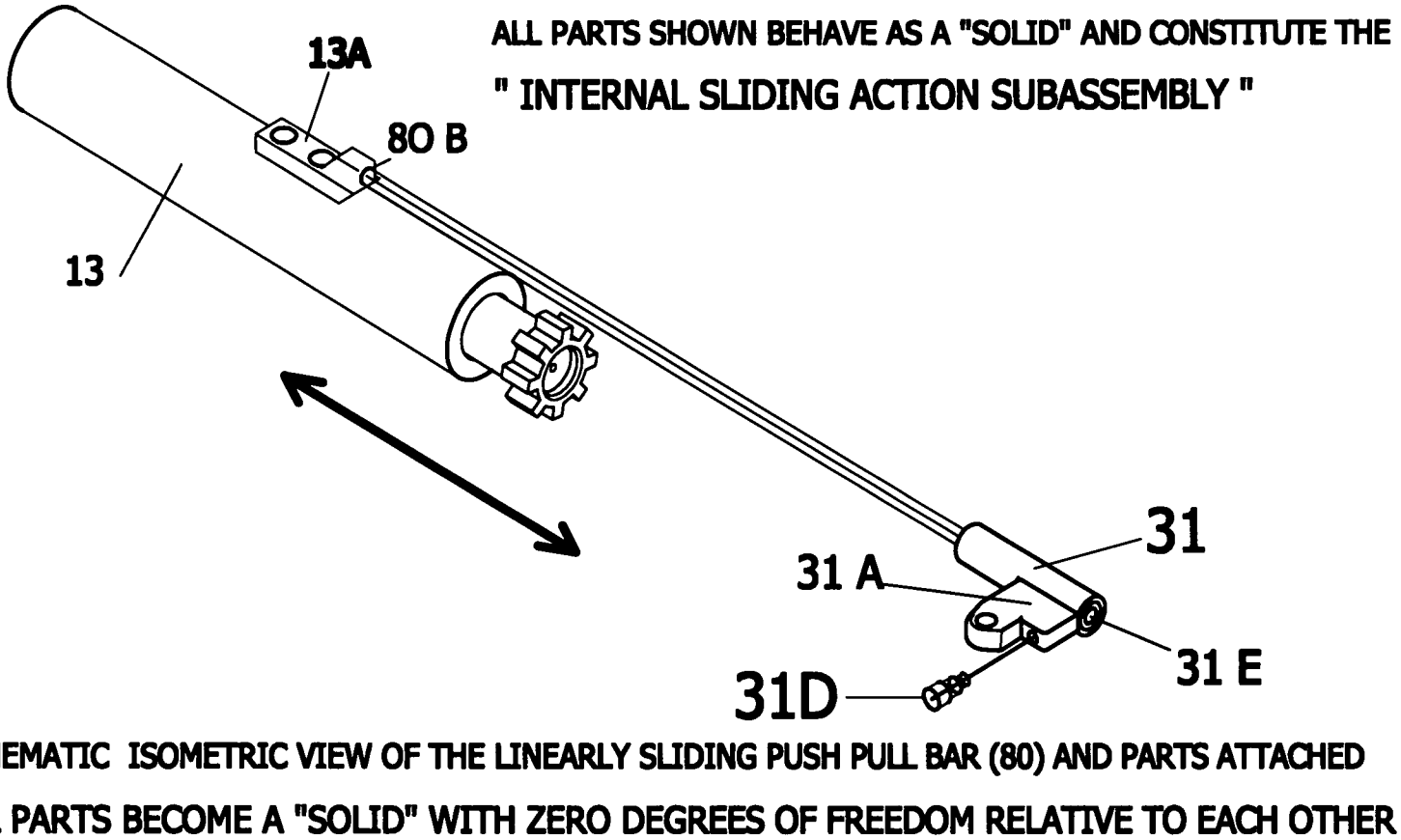

FIG. 16A Shows an orthographic top right view of a complete upper receiver and barrel with both hand guards and locking mechanism installed in. Shown with the external sliding handguard (95) in forward position. Bolt in Battery. Important to notice is the descriptive display of the External Connecting means, Post Connector (97) of the Sliding Hand Guard Group, to the Driver Plate (31A). This link part (97), transmits the force exerted by the shooter's hand over the forend slider (95) to the Driver Plate (31A), and to all the parts of The Internal Sliding Action Subassembly, as depicted in FIG. 7A.

FIG. 17 Shows a dual comparative schematic view of all the parts of the slide action rifle with bolt carrier locking mechanism external to the receiver in the first position, with the bolt in battery, and the other figure with the bolt in the open position.

Figure 18:
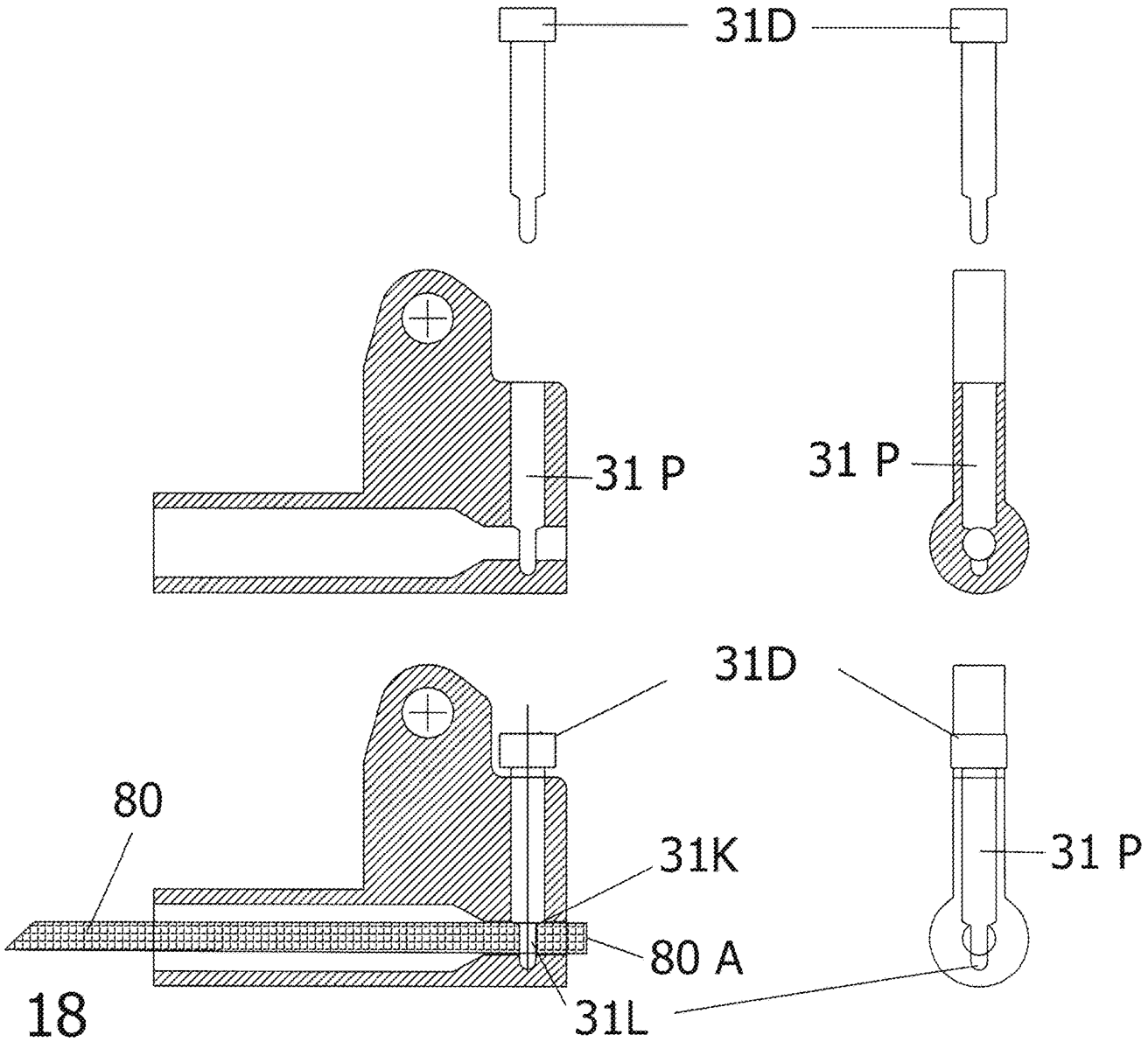
Figure 18A:
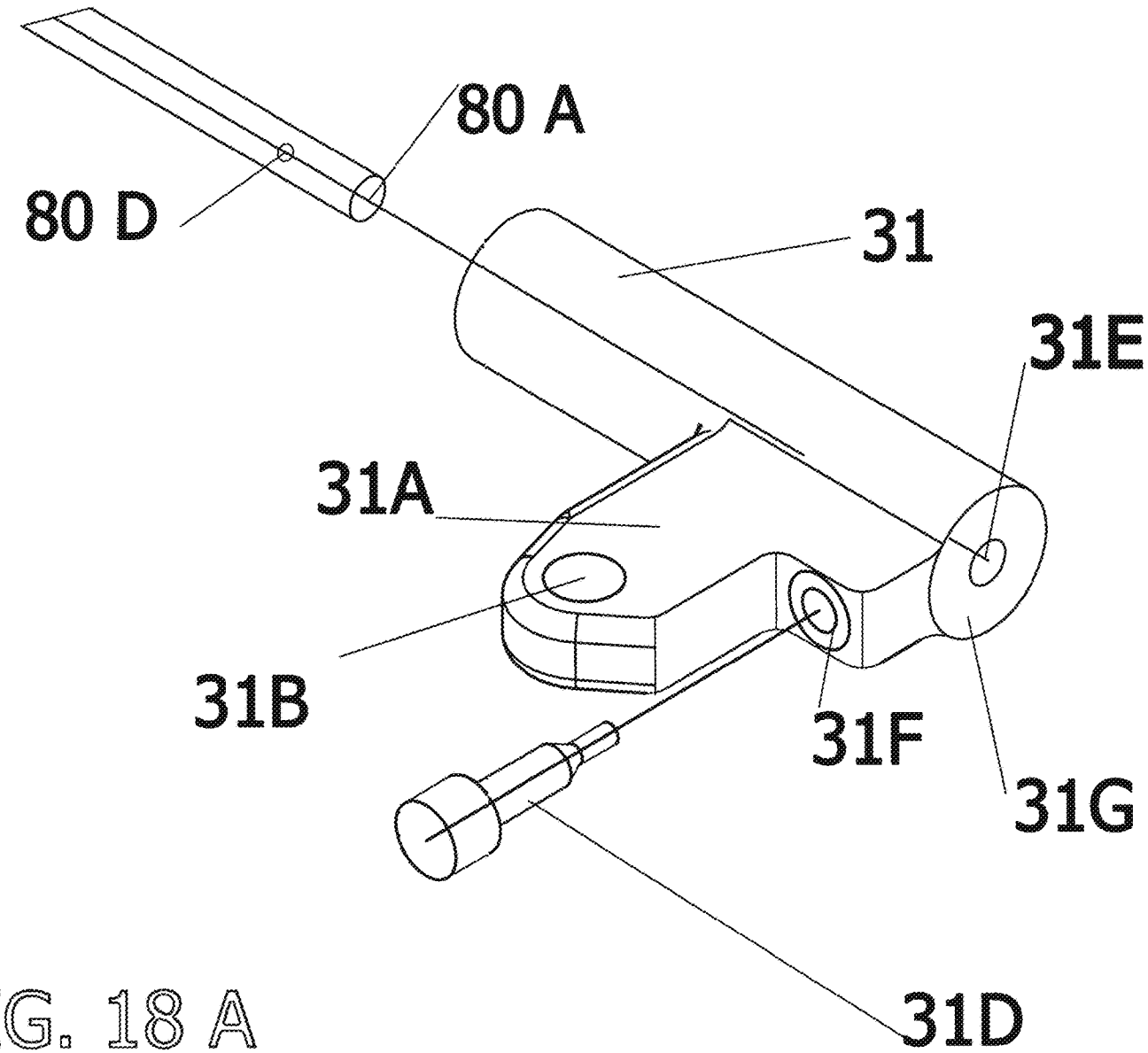

FIG. 18 Shows a cut view of the ROD DRIVER (31) and exterior plate (31A) to provide connection the exterior LOCKING LEVER (96) and THE SLIDER (95). As well shows the threaded zone (31 P), the (31 N), pin bed hole for pin insertion (31 M), to receive the (31 J), conical sector shoulder 31 K, round pin zone (31L), of the exterior rod driver clamp pin screw mechanism (31D). Correspondingly the lower views, side, and front section cuts, show the position of both the Push Pull Bar (80), and the Exterior Clamping Screw and Pin (31D) inserted, and positively affixing the Push-Pull Bar to the Driver (31), constraining the Bar (81) to zero degrees of freedom relative to the Driver (31).

FIG. 18 A Shows an descriptive isometric top right view of the rod driver (31) and the clamping screw and pin (31 D) way to assemble. Notice that the (31 D) has a tip pin at the end, which will penetrate into the HOLE (80D) when the screw if fully introduced into the ROD DIVER. This configuration of attaching the Push-Pull Rod actuator (80) to the Push-Pull cylindrical Rod Driver (31) results in being very novel and convenient for joining together the subassembly shown in FIG. 11A by means of part (97) connector post.

The (31 A) lateral exterior projection plate moves linearly sliding along the slot cut (70A) of the structural supporting guide tube (70) preventing any rotation of the subassembly. The (31 A) lateral exterior projection plate is placed in a horizontal plane when completely assembled.

Figure 19:
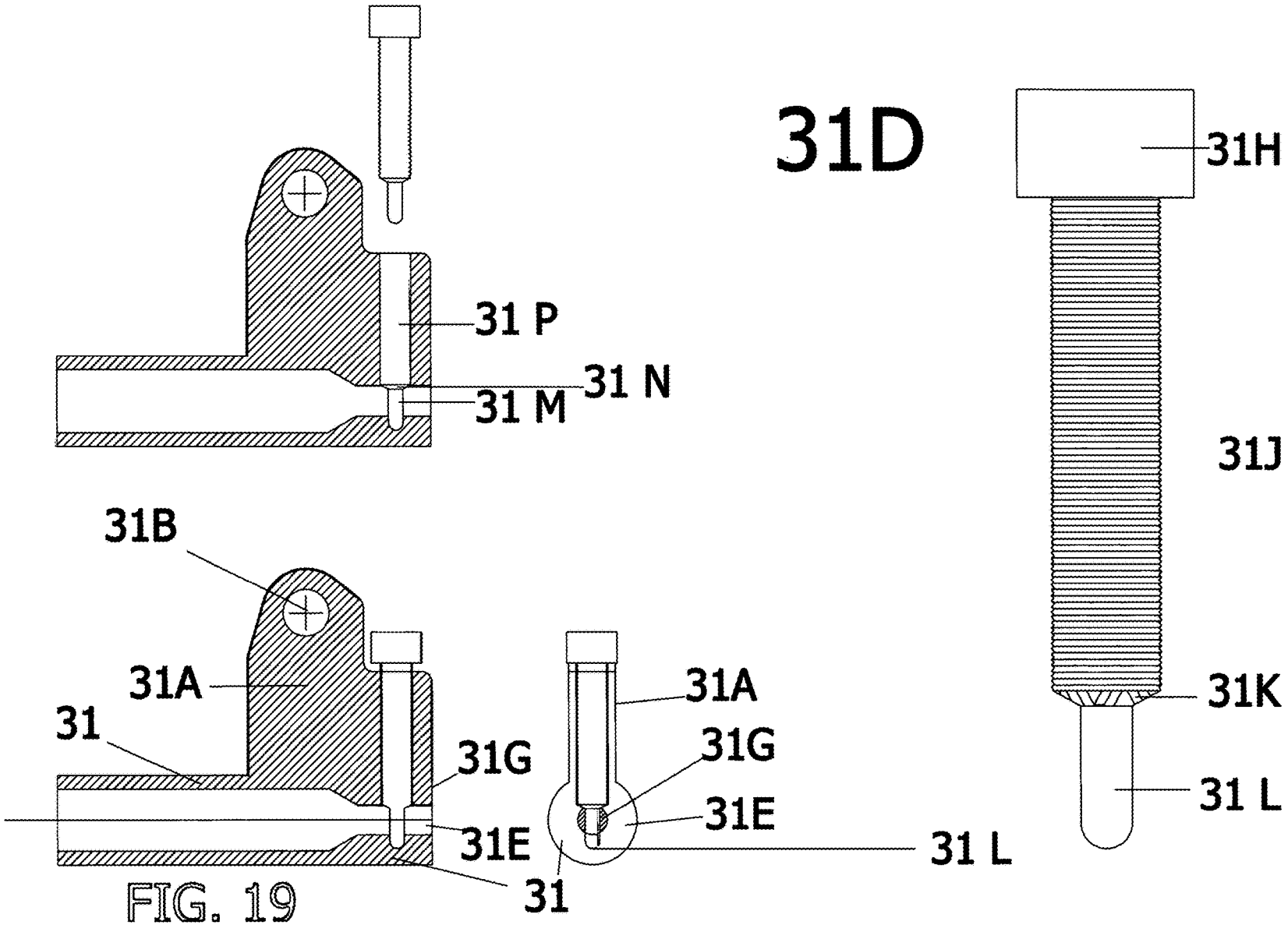

FIG. 19 Shows a very descriptive cut view of the Push-Pull Cylindrical Rod driver (31) which performs several functions. It couples solidly with the Forend (80 A) of the push-pull rod actuator (80), and the driver (31) by allowing the alignment of the Pin Portion (31 L) of the screw (31), to pass through the hole (80 D) sufficiently as to get fully inserted in the Pin Bed Hole (31 M), configuring a Pin subject to sear effort at both sides of the rod. The rod driver (31) serves as clamp body by housing to receive the mobile part of a clamp.

The Screw (31D) has as well as Conical Sector Shoulder (31 K) to contact a (31E) Conical Bed of the Rod (80) and press the opposite side Rod (80) against the internal wall of the Bore (31S), clamping very firmly and exerting a high pressure completely securing the fixation the Rod 80 and the Driver (31), and additionally the pinning clamp and pin device to positively affix the rod bar to the rod diver The Driver (31) has a lateral Exterior Projection Post connector Support Plate (31A) to provide exterior connection to the subassembly shown in FIG. 16 grouping an External sliding handguard (95), and a Locking Lever Mechanism (96) by means of the Connector Post (97).

Figure 20:
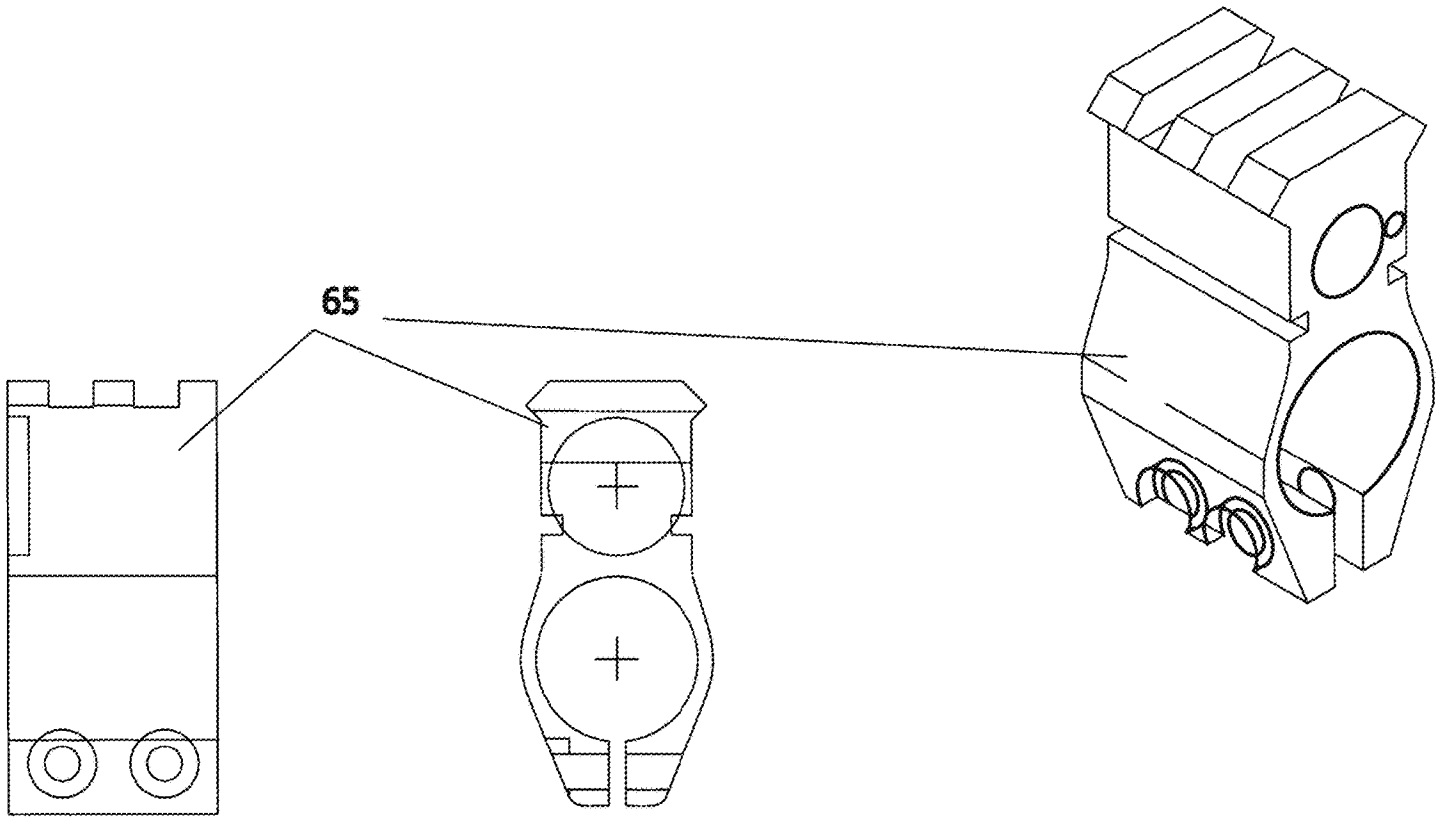

FIG. 20 Shows a side, a frontal, and an orthographic view of the ONE PIECE GAS SUPPRESSOR BLOCK (65) This piece executes two functions when coupled with the barrel (14) and seats against shoulder (14E), and seals hermetically the Barrel Gas Port (14A) of the barrel (14). And then clamp it, securing it tightly to the barrel (14). This tight closing of the barrel port (14), maintains all the gasses energy in propelling the projectile at its maximum potential and not even moving into plugged gas passages that are prone to leaking. The rear wall of the block provides a strong support to the front face (70 B) of the Structural Supporting Guide Tube (70). The rear face of the One piece gas suppressor block (65) has an undercut to fully constraint the motion of the tube. There is a pair of assemblelable upper (61), and lower (51) supports, which when assembled perform identical functions as the One piece support (65). See FIG. 5, FIG. 6, FIG. 7.

FIG. 21. Shows all the parts of the Rod Driver (34), and how it firmly connects to the ROD (80), by clamping and pinning the Rod after completely introducing the SCREW (31 D) into the (31 A) lateral projection plate or tongue. The distance (13 D) between the front of the bolt (13 C) and the Axis of alignment of the Hole (31 Q) must be maintained strictly to assure perfect penetration of the pin (31L) into the receptacle hole (31B) of the Rod driver (31)

OBJECTIVES OR GOALS

The Main Objective is to Create an External to the Receiver Locking Action Mechanism.

A list of innovative conceptions follows, wherein the order in which they are presented does not signify the importance relative to the other objectives or goals. However they are needed to be concurrent and interactive to support the above mentioned primary objective.

In the past it was frequently observed that the element connecting the movable forend Slider with the bolt carrier, often bent while pulling back strongly to eject an expanded or partially locked shell. Sometimes the connecting rod broke or drastically bent in the form of sudden Buckling. One Fulfilled Goal is to Avoid Buckling and Bending.

Buckling is a form of failure when the beam or column is subjected to an axial load which exceeds its tensile strength parallel to its long axis.

Buckling and bending may be present in the failure of a bar when loaded axially like a column, such as the case of the push-pull rod part number (80). In all previous Slide Action used in the past, especially when the ratio bar diameter/bar length is very small, sometimes the bars or plates presented Buckling.

Buckling is characterized by a sudden sideways failure of a structural member subjected to high compressive stress. As an applied load is increased on a member, such as a column, it will ultimately become large enough to cause the member to become unstable and is said to have buckled.

So, in order to prevent this happening while needing to use a relatively small diameter push pull bar (80), it is necessary to create a preventive array of parts as shown in FIG. 7 where a Structural supporting tube guide (70) is allocated between the receiver (16) and a frontal support, attached to the barrel (65) providing.

Inside the tube (70) the pull-push bar (80) slides linearly altogether with the protective rings (80 C) attached. The rings (80C), attached to the push pull bar (80) displace linearly close to the bore diameter of the Structural Tube (70) at with a small clearance, so that the slightest bending of the push pull bar (80) will force the external side of the ring to touch the internal bore of the strong structural tube, thus preventing the subsequent bending and buckling while the small diameter bar (80) is axially overloaded. Alternatively, the cylindrical rings (80C) may be fitted to contact tightly the inner bore of the Structural supporting tube guide (70), and said rings leaving a small gap between it and the push-pull rod actuator (80) to allow the free sliding motion, bur close enough to correct any further bending and buckling.

An array of parts to reinforce the strength of the push pull bar (80) function without significantly increasing either the size of the subassembly or its weight.

Another fulfilled Goal is to create an structural supporting guide tube (70) having a longitudinal axis parallel to the axis of the barrel but not in contact with said barrel as show in Figures.

Another fulfilled Goal is to create a multifunctional Driver part that will completely affix to the push-pull bar (80), being easily removable and locked from the exterior of the Tube (70) and having a projected plate to the exterior to receive Force and motion originated from the external force of the shooter's hand. Such multi-functional part is the Rod Driver (31). As described in all the related figures.

Another fulfilled Goal is to provide a Structural stationary guiding handguard (94), being a strong beam member totally constrained in motion relative to the receiver and the barrel (14), having the shape of an open concave polygon line, as described as example, in the FIG. 8, to be supported at the receiver 16 at the rear, and at the front by the frontal support (65). This exteriorly mounted beam (94) serves as internal stationary handguard having a channel shape (94A) at both external sides to serve as longitudinal guide for the sliding motion of a forend slider (95) which is hand actuated by the shooter. The stationary handguard (94) semi surrounding the barrel, defining a longitudinal axis parallel to the axis of the barrel, and without ever contacting the barrel.

Another fulfilled goal is to provide a set of supports for the stationary handguard (94), and to the structural guide tube (70) in a manner in which they affix to OEM existing shapes and dimensions of the receiver and the barrel without machining alterations.

Another fulfilled goal is to provide a mobile forend slider (95), having a shape capable of sliding linearly backwards and forwards in the exterior of the structural handguard (94), and to securely accommodate, integrally, inside one of the exterior stamped rails (95 A), an external pivoting locker lever (96), to execute a lock-un lock function.

Another fulfilled goal is to provide an exterior connection between the pivoting locker lever (96) member, and the laterally projected plate (31A) of the driver (31), by means of introducing a Connector post (97) through the hole (31 B) of (31A) plate and securing the post in Threaded hole (96 B) of pivoting locking lever (96).

This connection unites the linear action of the rod driver (31) and all parts subsequently attached with the locking lever, configuration a set of pieces which behave as a solid subassembly as well depicted in FIGS. 10, 11,11A, and 12).

With all the above exposed, it is evident that an innovative advantageous array of parts is making it possible to be used to transforming a Gas operated rifle design, like an AR-15, as an example, into an slide action manually actuated rifle.

Officially it is the same rifle, as none of the firing mechanisms or the lower receiver has been altered, conserving the original self-disconnecting feature. However the semi automatic gas actuated feature is being suppressed, transforming the category to a NON-automatic, manually operated rifle, which in all lawfulness it is not subject of the banning applied by some stated to the semi-automatic rifles. Another Fulfilled Goal is to Create Three Different Sub-Assemblies:

The Internal Sliding Action Subassembly, as depicted in FIG. 7A;

The External Sliding Action Subassembly, as depicted in FIGS. 10, 11, 11A; and The Complete Sliding Action Train, which is the union of the latter two Subassemblies as depicted in FIG. 12, 12 *a*, FIG. 13, FIG. 17

Completion of the Primary Objective or Goal.

Another fulfilled goal is to create An External To the Receiver Locking Action which occurs by the concurrence of all the herein described elements in this application and in the drawings. All previous patented pump action mechanism arrays have the locking action parts and motion housed inside the firearm receivers, normally close to the trigger and is disposed in a manner where the exterior lever to unlock the pump action is performed by the same hand which controls the trigger (the controlling hand).

In opposition the past seen customary mode, this application organizes the array of mechanisms in a manner in which the locking action of the linkage takes place exteriorly to the receiver, and more precisely in a mobile slidable array of mechanisms located in handguards and actuated by the supporting hand of the shooter. The locking lever arm (96) is mobile as well and the locking release takes place upon the action of a finger of the supporting hand of the shooter. Even the locking lever (96) actuator is in the very exterior of the hand guard.

All the drawings provided are in concordance with the goals exposed.

All the individual parts that constitute the Internal Sliding Action Subassembly are joint together in a manner that every single part has zero degrees of freedom relative to the joining part; and that the Complete Slide Action Train can be considered as a solid part moving along parallel axes to the axis of the barrel (14 A).

This array makes possible that the input force exerted over the sliding forend (95) by the shooters hand is transmitted to all the attached members of the kinematic chain, and to the Front face (13 C) of the bolt to Open and close the breech of the barrel. All of the above without interfering or modifying the OEM existing firing mechanisms housed in the lower receiver.

Operation

The actual locking action takes place due to the simultaneous intrusion of the Lock Action Intrusive Lug Projection (96F) of the sprigged biased Lock Action Lever Arm (96) into Both of the Through Cut Grounded Window (94B) of the Frontal Main Structural Grounded Stationary Handguard (94), and into the Through Cut Mobile Window (95 B) of External Sliding Handguard or Mobile Forend (95). The coincident position of both windows takes place only when the External Sliding Handguard or Mobile Forend (95) is in the most forward position and the breech is in battery. At that point, the rearwards motion of (95) is impossible due to the interference of Lock Action Intrusive Lug Projection (96F) into both windows making impossible the rearwards motion of the mobile Forend (95) until the Lug Projection (96F) moves out of the way by pressing the External Lock Action Release Bush Button (96E).

OPERATION of the rifle which has been adapted to eliminate the semi-automatic action, and adapted to operate with an external to the receiver slide action mechanism.

As a method of operation the following series should be followed of steps should be followed.

Proceed in the following manner:

1_Install the parts described in the following manner.

2_As an example, on a regular AR 15, remove the take down pins, and substitute the complete Regular Upper Receiver by an upper receiver which has been adapted to operate with the External To The Receiver Slide Action Mechanism, as described in the sections above.

3_Install a magazine loaded with live cartridges.

4_In a proper location for firing, turn the Safe selector to Fire position.

5_Depress the External Lock Action Release Push Button (96E) with the thumb finger of the supporting hand to free the locking mechanism action by removing the interfering Lock Action Intrusive Lug Projection (96F) from the, at this instance aligning, through cut Grounded windows (94B) and through cut Mobile window (95B), while maintaining the External Lock Action Release Push Button (96E) depressed.

6_Pull the External Sliding Handguard (95) all the way back; you may remove the thumb finger from the release button, and move forward, the External Sliding Handguard (95). This action will take a five round from the magazine and slide it into the barrel chamber (14C). The Lock Action Intrusive Lug Projection (96F) will penetrate automatically into the now aligned through cut window (94B) and through cut Mobile window (95B) which locks the entire linkage of linked parts including the bolt in the locked position in battery.

7_If wanting to fire, pull the trigger and proceed to cycle by continuing to numeral 5_. This will eject the empty case when pulling back the External Sliding Handguard (95), and continue in sequence repetition.

7A—If wanting to clear the barrel, rotate the safe selector to Safe, remove the loaded magazine, This action will eject the live round in the chamber.

Thus proceeding, a modified regular AR 15 rifle can only fired in a Slide Action Mode.

Uniqueness of this Invention

Buckling occur when a beam is subjected to axial compression. Failure is cause due to lateral deflection. So lateral deflection must be prevented early when staring.

Preventing bending and buckling of the push-pull bar (80) during rearwards action of the slide action is a major distinctive objective of the present application. A slender bar (80) is desirable in order to make the mechanisms suitable to be installed for retrofitting in certain types of firearms like for example AR-15, M-4, M-10, HK, 416, SIG 716, sig 516 and others, which have as OEM a gas impingement tube of small diameter and long length, and where in the orifice to allow such tube to pass into the OEM upper receiver is, accordingly, of small diameter too.

The boundary conditions, surrounding the slender bar, have a considerable effect on the critical load of slender columns. Consequently, providing structural support by an exterior structural guiding tube to the boundaries of the sliding reciprocating tube; and increasing the second moment of area of the cross section of the slender bar 80 by placing separately the of Cylindrical Rings 80C serves the prevention of buckling.

One way in which the present invention prevents buckling is by making the bar 80 to displace along an External Structural Supporting Guide Tube (70), and by the placing a number of Cylindrical Rings (80C) attachable either to the bar 80 in its exterior, or to the tube in its interior, in such a manner in which the rings (80C) are disposed to contact either the interior of the of the structural tube, in one case, or the bar in the other case, to offer supportive sliding alignment to the slender bar 80 in the event of the slightest bending from the axial displacing axis thus, maintaining alignment within tight tolerance and preventing bucking or harmonic vibrations of the bar 80.

ALTERNATIVE EMBODIMENTS

Rifles utilizing the present invention do not require the use of a main recovery spring that impulses the Bolt carrier (13) forward, and thus the space which holds the spring can be removed. This enables the substitution of regular stocks, and replacing it with Folding Stocks, reflecting in shorter overall length of the firearm enhancing the portability. Several firearms like AK 47, AR-15, M4, AR 10, H&K 416, SIG 516, AK74, SKS, Dragonov, Velmet, Galil might be subject of installation by making the proper supporting fixtures and shapes to install the required parts. Shotguns like the well-known Saiga having detachable magazines for feeding and rotary bolts are disposed to being adapted to this invention.

CONCLUSION, RAMIFICATIONS AND SCOPE

Accordingly, the reader will see that firearms described in one out of the several possible embodiments, will be improved in numerous ways in terms of ergonomy, comfort, recoil control, ease of manufacture, ease to serve, size of the weapon, weight of the weapon, stability, appearance, cost, concealability, and safety due to the simplified technology herein described.

Another important consideration in the present times (2017) is the fact that the adaptation of this set of parts to an upper receiver of a firearm will eliminate the gas operation and thus turning off the semi-automatic feature of the gun and changing the category of the rifle in which it is installed.

This novel device enables the easy factory conversion of new rifles to be marketed and sold as manually operated, instead of semi-automatic category.

Big areas of the world like Australia, New Zealand, and Europe do not allow the production, possession, and imports of semi-automatic rifles, and this new firearm category version fits all the requirements to be allowed for production, possession and import.

The prevalence of semi-automatic rifles in the market demand, and fabrication has left aside the superb opportunity of utilizing well proven existing rifle platforms. Several are a root for developing a future new version of OEM rifle Slide Action category by the addition of some novel mechanisms to bring to life slide action manually operating versions of rifles having detachable upper receivers holding a barrel, and lower receivers housing a firing mechanism comprising an automatic disengaging feature within.

The Government is now days changing the regulations for the exports procedures of firearms in an effort to increase the sales of that sector of the economy. The entity in charge of the simplified process will be the Secretary of Commerce having the objective of importantly increasing the Country participation in the firearms global Marker. The invention herein presented opens a great opportunity for the export of Modern Slide Action rifles utilizing the described technology.

What is claimed is:

1. A slide action conversion assembly for converting a gas operated rifle to a manually operated firearm comprising:

a tube support adapter plate (10) comprising a central barrel bore (10B), a rod bore (10C) and a plurality of rear pins (10A) configured to be received by semi-circular cuts of a barrel nut of the rifle;

a U-shaped hand guard support structure (17) secured to a forward face of the tube support adapter plate (10);

a tube supporting lug (11) received by the rod bore (10C), the tube supporting lug (11) comprising one or more annular insertion cuts (11A) and a rod bore guide (11B);

a structural supporting guide tube (70) comprising a fore end (70B) and a rear end (70C), the rear end (70C) received by an outer surface of the tube supporting lug (11), the guide tube (70) further comprising a slot cut (70A) extending from the fore end (70B) longitudinally along the guide tube and terminating at an intermediate portion thereof, the rear end (70C) comprising one or more locking protrusions (70D) each received by a respective annular insertion cut (11A) of the tube supporting lug (11);

a rod actuator (80) comprising a fore end (80A), a rear end (80B) and one or more cylindrical rings (80C) arranged on intermediate portions thereof, the rod actuator further comprising a transverse through hole (80D) positioned adjacent the fore end (80A), the rod actuator (80) slidably received within the guide tube (70);

a rod driver (31) comprising a clamp bore (31E), a lateral exterior projection (31A) and a transverse hole (31F), the clamp bore (31E) receiving the fore end (80A) of the rod actuator (80) such that transverse hole (31F) and through hole (80D) are aligned, the rod driver (31) further comprising a clamp screw (31D) received by the transverse hole (31F) and the aligned through hole (80D) for securing the rod driver (31) to the rod actuator (80), the lateral exterior projection (31A) projecting outwardly through the slot cutout (70A) in an assembled configuration;

a support block (65) comprising a barrel bore clamp (65A) and a tube support undercut (65C), the barrel bore clamp (65A) configured to securely affix to an exterior surface of a barrel of the firearm, the tube support undercut (65C) receiving the fore end (70B) of the structural support tube (70);

a stationary hand guard (94) comprising a rear connecting surface (94C) receiving the hand guard support structure (17), a front connecting surface receiving the support block (65), two channels (94A) oriented longitudinally on opposing exterior surfaces thereof and a through cut window (94B) positioned on a side thereof;

an external sliding handguard (95) configured to slide on the outer surface of the stationary hand guard (94), the sliding handguard (95) comprising a pair of laterally oriented guides (95A) each received by a corresponding channel (94A) of the stationary hand guard (94), the external sliding handguard (95) further comprising a through cut window (95B) on a same side as the through cut window (94B) of the stationary hand guard (94) so as to be in alignment when the sliding handguard (95) is positioned in a forward position on the stationary handguard (94);

a locking lever arm (96) comprising a lug (96F) on one end, a release push button (96E) at an opposing end, and a pivot pin hole (96A) positioned at an intermediate portion thereof, the locking lever arm (96) pivotally secured to the external sliding handguard by a pivot pin (96C) extending through the pivot pin hole (96A), the lug (96F) inwardly biased by a lever arm spring (96D) and configured to extend through both through cut windows (95A and 95B) when in alignment thereby placing the sliding handguard (95) in a locked configuration;

the lateral exterior projection (31A) of the rod driver (31) further comprising an upper bore (31B) and the locking lever arm (96) further comprising a lower bore (96B) for receiving a connector post (97) configured to secure the locking lever arm (96) to the rod driver (31); and a bolt carrier gas key replacement (13A) comprising a blind hole (13F) at a forward end thereof, the blind hole (13F) fixedly receiving the rear end (80B) of the rod actuator (80) in a manner that prevents decoupling during manual operation of a converted firearm.

* * * * *